US009248666B2

(12) United States Patent
Fuchioka et al.

(10) Patent No.: US 9,248,666 B2
(45) Date of Patent: Feb. 2, 2016

(54) DRYING APPARATUS AND PRINTING APPARATUS

(71) Applicant: DAINIPPON SCREEN MFG. CO., LTD., Kyoto (JP)

(72) Inventors: Hiroyuki Fuchioka, Kyoto (JP); Takeshi Katayama, Kyoto (JP); Akira Taiji, Kyoto (JP); Mitsuru Tanemoto, Kyoto (JP)

(73) Assignees: RICOH COMPANY, LTD., Tokyo (JP); SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 14/378,956

(22) PCT Filed: Jan. 18, 2013

(86) PCT No.: PCT/JP2013/000235

§ 371 (c)(1),
(2) Date: Aug. 14, 2014

(87) PCT Pub. No.: WO2013/121695

PCT Pub. Date: Aug. 22, 2013

(65) Prior Publication Data

US 2015/0174924 A1 Jun. 25, 2015

(30) Foreign Application Priority Data

Feb. 14, 2012 (JP) ..... 2012-029414
Mar. 29, 2012 (JP) ..... 2012-077660

(51) Int. Cl.
*B41J 2/01* (2006.01)
*B41J 11/00* (2006.01)
*B41J 15/04* (2006.01)

(52) U.S. Cl.
CPC ..... *B41J 11/0015* (2013.01); *B41J 11/002* (2013.01); *B41J 15/04* (2013.01)

(58) Field of Classification Search
CPC ..... B41J 11/0015; B41J 11/002; B41J 15/04
USPC ..... 347/102
See application file for complete search history.

(56) References Cited

U.S. PATENT DOCUMENTS

2011/0228289 A1 9/2011 Yamamoto et al.
2011/0267410 A1 11/2011 Yamamoto et al.

FOREIGN PATENT DOCUMENTS

JP 05-031893 A 2/1993
JP 2000-019877 A 1/2000

(Continued)

OTHER PUBLICATIONS

International Search Report issued in International Application No. PCT/JP2013/000235 with Date of mailing Feb. 19, 2013, with English Translation.

*Primary Examiner* — Stephen Meier
*Assistant Examiner* — Alexander D Shenderov
(74) *Attorney, Agent, or Firm* — McDermott Will & Emery LLP

(57) ABSTRACT

In an inkjet printing apparatus, heaters are enclosed with a heater casing, achieving accumulation of heated air and efficient performance of heating. A blowing fan blows air to the heaters. The heater casing includes a blowing port configured to narrow and blow warm air heated with the heaters to a transportation path outside the heater casing in a direction along the transportation path. The warm air narrowed at the blowing port obtains an increased air velocity thereof. In addition, uniform air-quantity distribution and uniform heat-quantity are obtainable. Moreover, the heaters face the transportation path. Consequently, the heaters are provided closer to the transportation path than a conventional external heater. This suppresses heat loss.

14 Claims, 19 Drawing Sheets

(56) References Cited

FOREIGN PATENT DOCUMENTS

| | | | |
|---|---|---|---|
| JP | 2001-334647 | A | 12/2001 |
| JP | 2007-303432 | A | 11/2007 |
| JP | 2009-045861 | A | 3/2009 |
| JP | 2010-076404 | A | 4/2010 |
| JP | 2010-082937 | A | 4/2010 |
| JP | 2010-137399 | A | 6/2010 |
| JP | 2010-188708 | A | 9/2010 |
| JP | 2011-168021 | A | 9/2011 |
| JP | 2011-230494 | A | 11/2011 |

(a)

(b) P-P (c) Q-Q (a)

(b)

DRYING APPARATUS AND PRINTING APPARATUS

RELATED APPLICATIONS

This application is the U.S. National Phase application under 35 U.S.C. §371, of international Application No. PCT/JP2013/000235 filed on Jan. 18, 2013, which in turn claims the benefit of Japanese Application No. 2012-029414 filed on Feb. 14, 2012, and Japanese Application No. 2012-077660 filed on Mar. 29, 2012, the disclosure of which Application is incorporated by reference herein.

TECHNICAL FIELD

The present invention relates to a drying apparatus configured to dry ink droplets adhering to a print medium and a printing apparatus.

BACKGROUND ART

Conventional examples of such an apparatus include an inkjet printing apparatus. The inkjet printing apparatus includes inkjet heads configured to discharge ink droplets to a print medium (e.g., web paper), a mechanism configured to move the inkjet heads and the print medium relatively, and a drying unit configured to dry the ink droplets adhering to (impacting on) the print medium.

Examples of the drying unit include one having a heat drum (also referred to as a heating roller) with a heater embedded therein. See, for example, Japanese Patent Publication No. 2010-188708A. A back face of the print medium contacts the heat drum, and is wound on the heat drum. Here, the heat drum is pre-heated. Accordingly, when the print medium passes while being wound on the heat drum, the ink droplets adhering to the print medium is dried with heat from the heat drum. Examples of the drying unit include another one having a warm-air supplying unit configured to supply warm air to a front face of a printing sheet. See, for example, Japanese Patent Publication No. 2010-082937A. A conventional inkjet printing apparatus 301 includes a drying unit 319. The drying unit 319 includes a heat drum 331 and additionally a warm-air supplying unit 333 as illustrated in FIG. 20. Here, the inkjet head is denoted by a numeral 323, and the print medium (web paper) is denoted by a numeral WP.

Moreover, Japanese Patent Publication No. 2011-230494A discloses an inkjet recorder. The inkjet recorder includes a blowing mechanism configured to blow hot air onto a recording medium (a print medium) to be transported, and a preheating unit configured to heat the print medium at an upstream side in an area in a direction in which the hot air flows. Japanese Patent Publication No. 2010-137399A discloses an inkjet recording device having a suction platen that achieves stable sucking of a sheet held with the platen by acting a suction force on a back face of the sheet.

PATENT LITERATURE

Patent Literature 1

Japanese Patent Publication No. 2010-188708A

Patent Literature 2

Japanese Patent Publication No. 2010-082937A

Patent Literature 3

Japanese Patent Publication No. 2011-230494A

Patent Literature 4

Japanese Patent Publication No. 2010-137399A

However, the examples of the conventional apparatus with such constructions as above have the following drawbacks. Specifically, the conventional inkjet printing apparatus 301 includes the drying unit 319. The drying unit 319 includes the heat drum 331, and the warm-air supplying unit 333. The warm-air supplying unit 333 is separated from the inkjet printer 302 for readily obtaining a large quantity of air and heat. The warm-air supplying unit 333 disposed separately is formed by a blowing source (blower) 339, a heater 337, and a duct 344 in this order. The blowing source 339 blows air heated with the heater 337 through the duct 344 to the surrounding of the heat drum 331. In the drying unit 319 having such a warm-air supplying unit 333, a length of the duct 344 causes increased pressure loss and heat loss, making it difficult to achieve uniform quantity distribution and uniform heat-quantity supply of warm air. Such a drawback may arise. Moreover, there is a desire to embed the separated warm-air supplying unit 333 into the inkjet printer 302.

Moreover, the conventional inkjet printing apparatus has another drawback as under. Specifically, the print medium is transported by driving a drive roller. Typically, the drive roller is pressed with a nip roller (pressure roller) across the print medium. This causes a gripping force upon transporting the print medium. When a nip roller is adopted as a rotatory-driving heat drum to obtain a gripping force like the other drive rollers, the nip roller is disposed at a downstream side in a transportation direction of the print medium. When the heating roller performs insufficient heating, the ink droplets are brought into adhesion to the nip roller that contacts a face of the print medium to which the ink droplets adhere. As a result, the nip roller with the ink droplets adhering thereto may stain other portions in a printing face of the print medium. Accordingly, a gripping force is obtained with no nip roller by applying tension to the print medium to press the print medium against the heat drum. On the other hand, there is another desire to increase pressure as much as possible to obtain a sufficient gripping force.

The present invention has been made regarding the state of the art noted above, and its primary object is to provide a drying apparatus and a printing apparatus that decrease loss and allow uniform quantity distribution and uniform heat-quantity supply of warm air.

A second object of the present invention is to provide a drying apparatus and a printing apparatus that allow obtaining a gripping force upon transporting a print medium.

Solution to Problem

The present invention is constituted as stated below to achieve the above object. One embodiment of the present invention discloses a drying apparatus for drying ink adhering to a print medium. The drying apparatus includes a heater facing a transportation path where the print medium is transported, a blowing source configured to blow air to the heater, and a casing configured to enclose the heater. The casing includes an inflow port into which the air from the blowing source flows, and a blowing port configured to narrow and blow warm air heated with the heater to the transportation path outside the casing in a direction along the transportation path.

With the drying apparatus according to the embodiment, the heater is enclosed with the casing. Consequently, accumulation of heated air is achieved, leading to effective heating. The blowing source blows air to the heater enclosed with the casing. The casing includes the inflow port, and the blowing port configured to narrow and blow the warm air heated with the heater to the transportation path outside the casing in the direction along the transportation path. The warm air is narrowed at the blowing port, obtaining an increased velocity thereof. Consequently, a desired air velocity is obtainable even with slow air from the blowing source. Moreover, the warm air is narrowed at the blowing port. This achieves uniform quantity distribution and uniform heat-quantity supply of warm air. The heater faces the transportation path where the print medium is transported. Consequently, the heater is disposed closer to the transportation path than the conventional external heater. This suppresses heat loss. As a result, the heater with low heating power can perform efficient heating.

Moreover, it is preferable that the drying apparatus according to the embodiment includes an exhaust unit disposed outside the casing and configured to exhaust the warm air blown through the blowing port to the transportation path. This achieves exhaust of the warm air blown to the transportation path and containing moisture of the ink, thereby drying the ink efficiently.

Moreover, it is preferable that the drying apparatus according to the embodiment includes a suction unit configured to supply air to the blowing source, and a warm-air circulator configured to supply the warm air collected in the exhaust unit to the suction unit. The warm-air circulator supplies the warm air to the suction unit configured to supply air to the blowing source. Here, the warm air is blown to the transportation path and collected in the exhaust unit. Consequently, the heater does not heat outside air (fresh air) but heats air heated once, achieving efficient heating.

Moreover, the suction unit of the drying apparatus according to the embodiment includes an outside-air suction port configured to suck outside air, a warm-air suction port provided as the exhaust unit and the warm-air circulator on a path connecting the blowing source and the outside-air suction port, and configured to suck the warm air blown to the transportation path, and a suction-blowing source provided on the path adjacent to the outside-air suction port rather than the warm-air suction port, and configured to suck the outside air. The suction-blowing source is preferably set to blow a smaller quantity of air than the blowing source. Consequently, difference in quantity of air occurs between the blowing source and the suction-blowing source. The difference in quantity of air causes a suction force that sucks the warm air from the warm-air suction unit.

Moreover, in the drying apparatus according to the embodiment, a plurality of warm-air blowing units each having the heater, the blowing source, and the casing is provided along the transportation path. Letting the plurality of adjacent warm-air blowing units be a pair, the warm-air suction unit is preferably disposed between the plurality of adjacent warm-air blowing units. Entering air into the warm-air suction unit from other than the warm-air blowing unit causes decrease in temperature of the warm air to be sucked. Here, the warm-air suction port is disposed between the plurality of adjacent warm-air blowing units, achieving suction of the warm air with high temperatures. Consequently, the warm-air blowing unit allows blowing of the warm air heated efficiently.

Moreover, it is preferable that the drying apparatus according to the embodiment includes a dry controller configured to change difference in quantity of air between the blowing source and the suction-blowing source. This allows changing a proportion of the warm air to be circulated.

Moreover, it is preferable that the blowing source of the drying apparatus according to the embodiment is disposed at the inflow port of the casing. This achieves a closer distance to the transportation path than the conventional external blowing source, thereby suppressing the pressure loss. Moreover, the blowing source disposed at the inflow port of the casing causes the heater to be enclosed with the casing and the blowing source. This achieves sufficient accumulation of the heated air, leading to efficient heating.

Moreover, the drying apparatus according to the embodiment preferably includes a temperature sensor disposed at the blowing port, and a dry controller configured to control a quantity of air from the blowing source in accordance with a temperature measured with the temperature sensor. The dry controller preferably controls the quantity of air from the blowing source so as to be lower as the temperature measured with the temperature sensor decreases. This causes rapid rising of the temperature of the warm air from the blowing port to a temperature set in advance.

Moreover, the drying apparatus according to the embodiment preferably includes a drive roller configured to rotate while contacting to a face of the print medium opposite to a face to which the ink adheres, and a housing configured to partially cover the transportation path on an outer edge of the drive roller. The warm-air blowing unit including the heater, the blowing source, and the casing preferably blows the warm air to the transportation path covered with the housing. The warm-air blowing unit blows the warm air to the transportation path covered with the housing. This achieves the housing having an internal pressure higher than an external pressure, causing static pressure. Consequently, a gripping force is obtainable upon transporting the print medium through rotation of the drive rollers. In addition, the static pressure by air is generated toward the transportation path, preventing staining of the print medium.

Moreover, the drive roller of the drying apparatus according to the embodiment is preferably a heat drum that rotates and performs heating while contacting the face of the print medium opposite to the face to which the ink adheres. Consequently, the heat drum contacts and heats the face (back face) opposite to the face to which the ink of the print medium adheres. This achieves drying of the ink adhering to the print medium.

Moreover, the housing of the drying apparatus according to the embodiment preferably includes a static pressure adjusting device configured to maintain static pressure during passing the print medium through the housing by at least either gradually increasing the static pressure at an inlet of the housing or gradually decreasing the static pressure at an outlet of the housing. This achieves the maintained pressure within the housing.

Moreover, in the drying apparatus according to the embodiment, the print medium is preferably fed from a roll of print medium. The drive roller with an insufficient gripping force causes slip of the print medium, leading to unstable transportation of the print medium. Consequently, the print medium supplied from the roll makes it difficult to control the print medium together with the other drive rollers so as to be transported stably. However, the gripping force is obtained with a static pressure generator, achieving stable control for transportation.

Moreover, the drying apparatus according to the embodiment preferably includes a back-face drying unit disposed opposite to the blowing port across the transportation path and configured to dry the ink adhering to the print medium by heating a back face of the print medium. The blowing port preferably blows the warm air to a front face of the print medium. The blowing port blows the warm air to the front face of the print medium to which the ink adhering, thereby drying the ink droplets. At the same time, the back-face drying unit disposed opposite to the blowing port across the transportation path heats and dries the back face of the print medium. This achieves efficient drying of the ink.

Moreover, in the drying apparatus according to the embodiment, a plurality of warm-air blowing units each having the heater, the blowing source, and the casing is preferably arranged along the transportation path. A plurality of warm-air blowing units along the transportation path achieves arrangement of a large number of heaters and blowing sources closer to the transportation path. This allows reduced heat loss and pressure loss.

Moreover, in the drying apparatus according to the embodiment, the blowing source is preferably constituted by a combination of a plurality of fans arranged in series. Consequently, high setting density and a large quantity of air are obtainable. Accordingly, decrease in quantity of air and in velocity of air is avoidable although the warm air enters into a place with drag, such as the casing.

Moreover, another embodiment of the present invention discloses a printing apparatus configured to perform printing to a print medium. The printing apparatus includes a drying unit configured to dry ink adhering to the print medium. The drying unit includes a heater facing a transportation path where the print medium is transported, a blowing source configured to blow air to the heater, and a casing configured to enclose the heater. The casing includes an inflow port into which the air from the blowing source flows, and a blowing port configured to narrow and blow the warm air heated with the heater to the transportation path outside the casing in a direction along the transportation path.

With the printing apparatus according to the embodiment, the heater is enclosed with the housing. Consequently, accumulation of heated air is achieved, leading to effective heating. The blowing source blows air to the heater enclosed with the casing. The casing includes the inflow port, and the blowing port configured to narrow and blow the warm air heated with the heater to the transportation path outside the casing in the direction along the transportation path. The warm air is narrowed at the blowing port, obtaining an increased velocity thereof. Consequently, a desired air velocity is obtainable even with slow air from the blowing source. Moreover, the warm air narrowed at the blowing port achieves uniform quantity distribution and uniform heat-quantity supply of warm air. The heater faces the transportation path where the print medium is transported. Consequently, the heater is disposed closer to the transportation path than the conventional external heater. This suppresses heat loss. As a result, a heater with low heating power can perform heating efficiently.

Moreover, the specification also discloses another embodiment of the drying apparatus as under.

(1) In the drying apparatus according to the embodiment, the exhaust port is preferably disposed at an upstream side of the casing along the transportation path, and the casing preferably includes the blowing port so as to blow the warm air obliquely from downstream to upstream sides of the transportation path. This achieves an enhanced relative speed of the print medium transported to the transportation path and the warm air from the blowing port. Consequently, efficient drying of the ink is obtainable.

(2) In the drying apparatus according to the embodiment, the exhaust units are preferably disposed at both sides of the transportation path across the casing, and the casing preferably includes the blowing port so as to blow the warm air vertically to the transportation path. This ensures to blow the warm air in a front direction of the print medium transported on transportation path.

Advantageous Effects of Invention

With the drying apparatus and the printing apparatus according to the embodiment, the heater is enclosed with the casing. Consequently, accumulation of heated air is achieved, leading to effective heating. The blowing source blows air to the heater enclosed with the casing. The casing includes the inflow port, and the blowing port configured to narrow and blow the warm air heated with the heater to the transportation path outside the casing in the direction along the transportation path. The warm air is narrowed at the blowing port, obtaining an increased velocity thereof. Consequently, a desired air velocity is obtainable even with slow air from the blowing source. Moreover, the warm air narrowed at the blowing port achieves uniform quantity distribution and uniform heat-quantity supply of warm air. The heater faces the transportation path where the print medium is transported. Consequently, the heater is provided closer to the transportation path than the conventional external heater. This suppresses heat loss. As a result, the heater with low heating power can perform heating efficiently.

According to the embodiment, the warm-air blowing unit blows the warm air to the transportation path covered with the housing. This achieves the housing having the internal pressure higher than the external pressure, causing static pressure. Consequently, a gripping force is obtainable upon transporting the print medium through rotation of the drive rollers. In addition, the static pressure by air is generated toward the transportation path, preventing staining of the print medium.

EMBODIMENT 1

Figure 1:
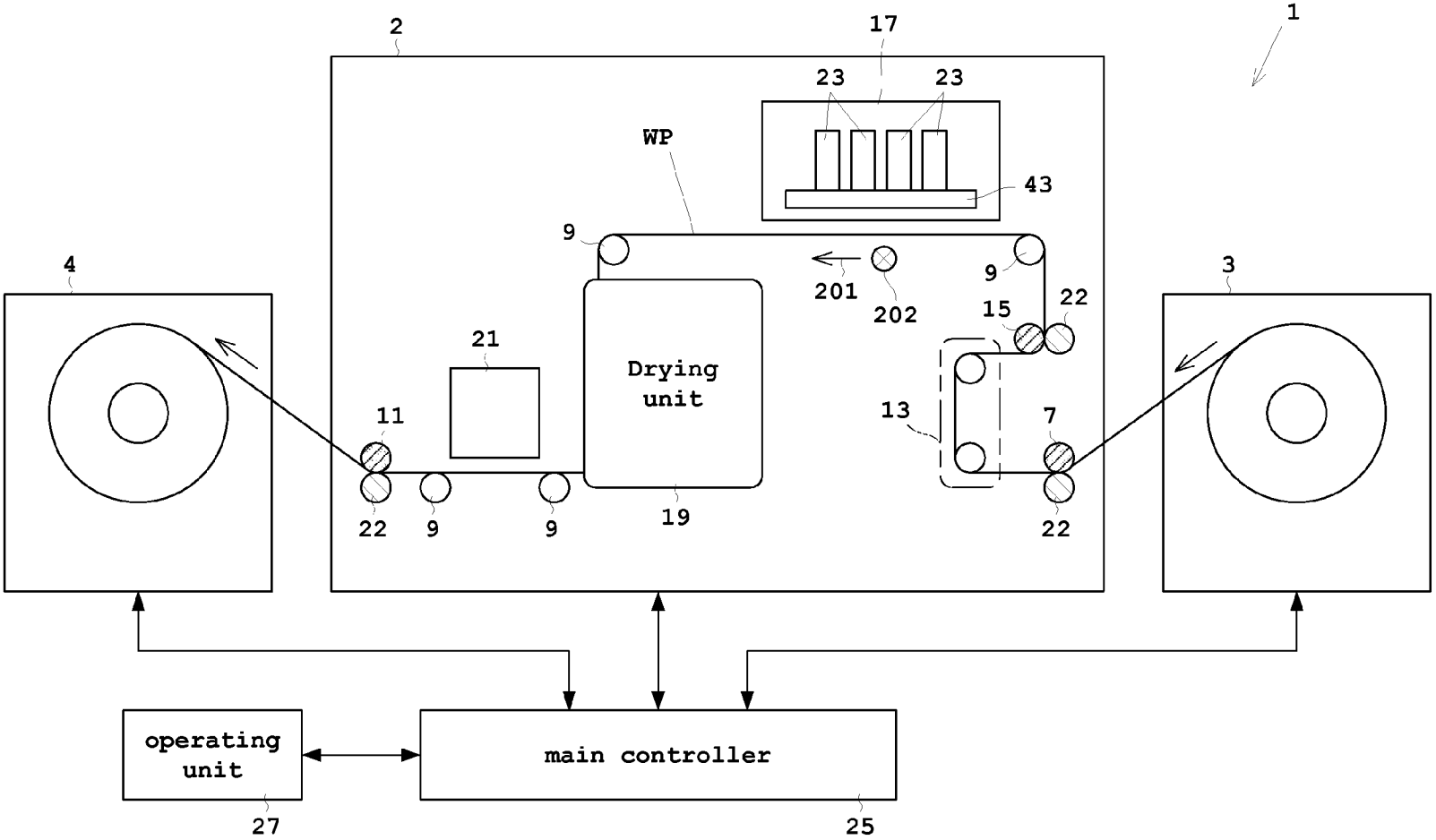
FIG. 1 is a schematic view of an inkjet printing apparatus according to Embodiment 1.
Figure 2:
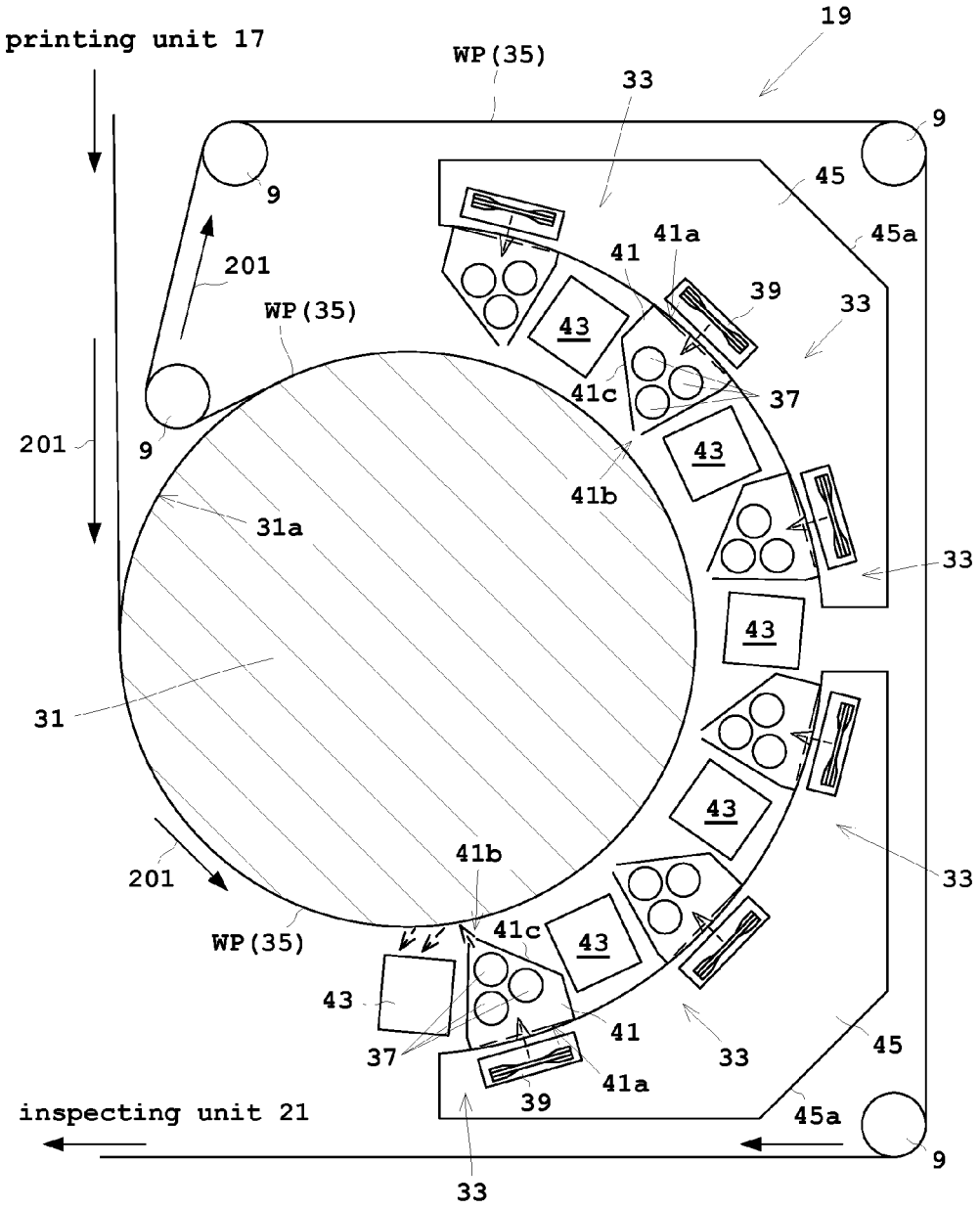
FIG. 2 is a side view of a drying unit according to the embodiment.
Figure 3:
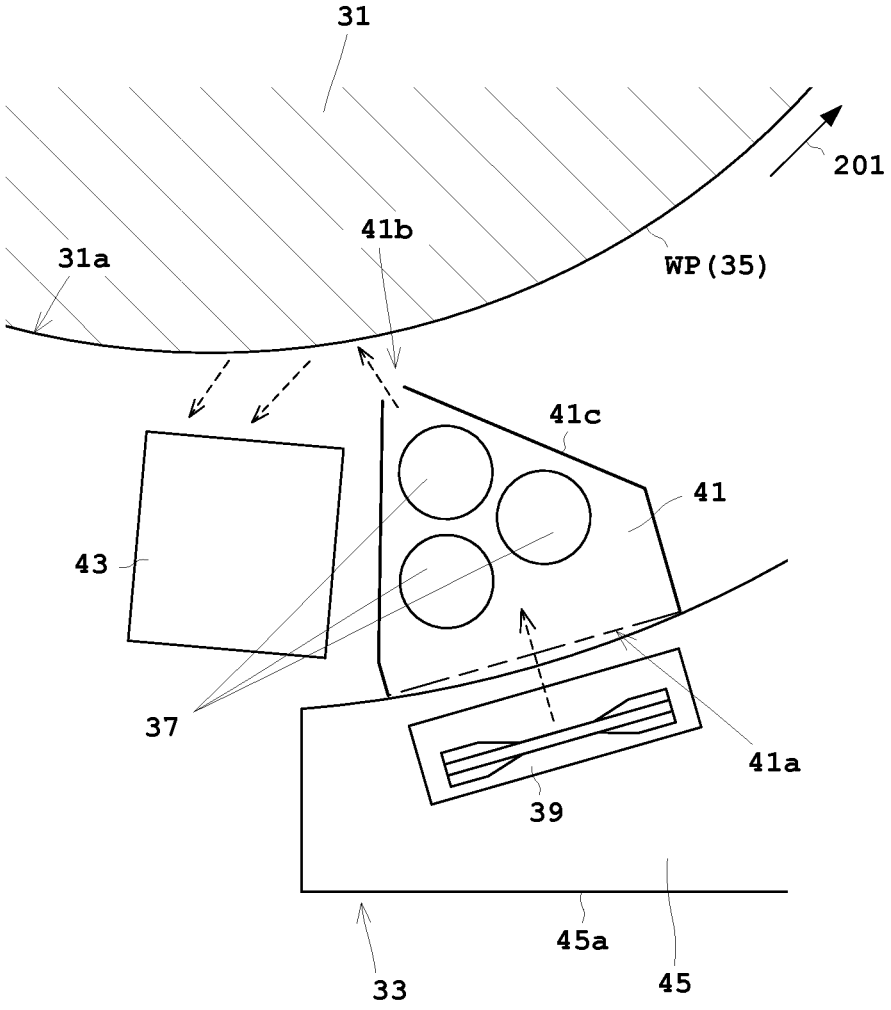
FIG. 3 is a side view of a warm-air blowing unit in the drying unit according to the embodiment.

Description will be given of Embodiment 1 of the present invention with reference to drawings. FIG. 1 is a schematic view of an inkjet printing apparatus according to the embodiment. FIG. 2 is a side view of a drying unit according to the embodiment. FIG. 3 is a side view of a warm-air blowing unit of the drying unit according to the embodiment.

Reference is now made to FIG. 1. An inkjet apparatus 1 includes an inkjet printing unit 2, a paper feeder 3, and a take-up roller 4. The inkjet printing unit 2 performs printing on sheet-like web paper WP. The paper feeder 3 feeds the web paper WP to the inkjet printing unit 2. The take-up roller 4 winds the printed web paper WP into a roll form. Here, the web paper corresponds to the print medium in the present invention. The inkjet printing apparatus 1 corresponds to the printing apparatus in the present invention.

The paper feeder 3 holds a roll of the web paper WP so as to be rotatable about a horizontal axis, and unreels the web paper WP from the roll of the web paper WP to feed the web paper WP to the inkjet printing unit 2. The take-up roller 4 reels the web paper WP printed by the inkjet printing unit 2 about a horizontal axis. Regarding the side from which the web paper WP is fed as upstream and the side to which the web paper WP is taken up as downstream, the paper feeder 3 is disposed upstream of the inkjet printing apparatus 2 while the take-up roller 4 is disposed downstream of the inkjet printing unit 2.

The inkjet printing unit 2 includes a driving roller 7 in an upstream position thereof for taking in the web paper WP from the paper feeder 3. The web paper WP unreeled from the paper feeder 3 by the drive roller 7 is transported downstream toward the take-up roller 4 on rotatable transport rollers 9 having no drive mechanism. A drive roller 11 is disposed between an inspecting section 21, to be mentioned later, and the take-up roller 4. The drive roller 11 feeds the web paper WP passing through an inspecting section 21, to be mentioned later, toward the take-up roller 4.

Between the drive roller 7 and the drive roller 11, the inkjet printing unit 2 includes an edge position controller 13, a drive roller 15, a printing unit 17, a drying unit 19, and an inspecting unit 21 arranged in this order from upstream to downstream sides. When the web paper WP serpentines, the edge position controller 13 automatically adjusts the web paper WP to transport the web paper WP into a right position. The driving roller 15 rotates at a fixed speed. The speed corresponds to a reference for a number of revolutions of other driving rollers 7 and 11 and a heat drum 31 to be mentioned later. Here, the drying unit 19 corresponds to the drying apparatus in the present invention.

Each of the driving rollers 7, 11, and 15 is provided with a rotatable nip roller 22. The nip rollers 22 each press the driving rollers 7, 11, and 15 across the web paper WP, thereby applying a transportation force (a gripping force) of the web paper WP. Pressure is applied by an air cylinder, for example. The rip roller 22 is composed of an elastic body such as rubber.

The printing unit 17 includes inkjet heads 23 for discharging ink droplets (ink). The printing unit 17 has a plurality of inkjet heads 23. The inkjet heads 23 are formed in a staggered arrangement in a width direction (primary scanning direction) 202 of the web paper WP perpendicular to a transportation direction (secondary scanning direction) 201 of the web paper WP. Consequently, the inkjet heads 23 discharge ink droplets to the web paper WP while the web paper WP is transported with a position thereof being fixed without moving in the width direction 202 of the web paper WP perpendicular to the transportation direction 201 of the web paper WP. Hereinunder, description will be given of the inkjet heads 23 formed in the width direction 202 in the staggered arrangement as one inkjet head 23. The printing unit 17 includes a plurality of inkjet heads 23 being arranged in the transport direction of the web paper WP. For instance, four inkjet heads 23 are provided separately for black (K), cyan (C), magenta (M), and yellow (Y). The printing unit 17 is connected to an ink supply section, not shown, for supplying ink droplets to the printing unit 17 as required.

The drying unit 19 dries the ink droplets discharged from the inkjet heads 23 and adhered to the web paper WP. The drying unit 19 is to be mentioned later. The inspecting unit 21 inspects the printed portions for any stains or omissions. The take-up roller 4 reels the inspected web paper WP in a roll form.

The inkjet printing apparatus 1 also includes a main controller 25 and an operating unit 27. The main controller 25 controls each element of the inkjet printing apparatus 1 en bloc, and is formed by a central processing unit (CPU) and others. The operating unit 27 operates the inkjet printing apparatus 1, and is formed by a touch panel, various switches and others. The operating unit 27 also includes a personal computer and may input operations via a mouse, a keyboard, and others. The driving rollers 7, 11, and 15 and the heat drum 31, to be mentioned later, are rotated with a drive mechanism, not shown, such as a motor and a gear.

Drying Unit

Reference is made to FIGS. 2 and 3. The drying unit 19 includes the heat drum 31 and warm-air blowing units (warm-air supplying units) 33. As above, the heat drum 31 has a heater, not shown, embedded therein, and performs heating to a temperature set in advance. For instance, the heat drum 31 includes a heater embedded therein, such as a halogen heater or a ceramic heater. The heat drum 31 is made of metal such as stainless steel. The heat drum 31 contacts and heats a back face of the web paper WP, i.e., a face opposite to a face of the web paper WP to which the ink droplets adheres. Moreover, the heat drum 31 rotates similarly to the drive rollers 7, 11, and 15. The web paper WP is wound on an outer edge 31*a* of the heat drum 31. Specifically, the heat drum 31 heats the back face of the web paper WP and dries the ink droplets while transporting the web paper WP. Here, the heat drum 31 corresponds to the back-face drying unit and the drive roller in the present invention.

The warm-air blowing unit 33 faces the transportation path 35 where the web paper WP is transported. Moreover, a plurality of warm-air blowing units 33 is arranged along an outer periphery of the heat drum 31, i.e., along the transportation path 35. The warm-air blowing unit 33 includes heaters 37, a blowing fan 39, a heater casing 41, an exhaust duct 43, and a suction duct 45. Here, the blowing fan 39 corresponds to the blowing source in the present invention. The heater casing 41 corresponds to the casing in the present invention. The exhaust duct 43 corresponds to the exhaust unit in the present invention. The suction duct 45 corresponds to the suction unit in the present invention.

The heater 37 faces the transportation path 35 where the web paper WP is transported, and heats air. For instance, the heater 37 is formed by a sheathed heater. Alternatively, the heater 37 may be another heat source such as one that generates heat through conduction of electricity. The blowing fan 39 blows air to the heater 37. The blowing fan 39 is preferably formed by a combination of a plurality of fans in series, e.g., a counter-rotating fan. Consequently, high setting density of fans and a large quantity of air are obtainable. Accordingly, this obtains a property of the fan that decrease in quantity of air and in air velocity is avoidable even when air flows into a place, such as the heater casing 41, with drag. The blowing fan 39 may be another blowing source, such as another type of fans and blowers.

The heater casing 41 encloses the heater 37. The heater casing 41 includes an inflow port 41*a* into which the air from the blowing fan 39 flows, and a blowing port 41*b* configured to narrow and blow the warm air heated with the heater 37 to the transportation path 35 outside the heater casing 41 in a direction along the transportation path 35. The heater casing 41 is constituted such that a partition 41*c* becomes narrower in the direction along the transportation path 35 toward the blowing port 41*b*. In addition, the heater casing 41 further includes the blowing port 41*b* configured to blow the warm air obliquely from downstream to upstream sides of the transportation path 35. The heat drum 31 is provided opposite to the blowing port 41*b* across the transportation path 35 where the web paper WP is transported. The blowing port 41*b* blows the warm air to the front face of the web paper WP.

The heater casing 41 almost encloses the heater 37 other than the inflow port 41*a* and the blowing port 41*b*. The heater casing 41 is made of a heat resisting material, e.g., a metal such as stainless steel or plastic coated with a heat resisting coating. The blowing port 41*b* is disposed adjacent to the transportation path 35 (for example, by 10 mm).

The exhaust duct 43 is outside the heater casing 41. The exhaust duct 43 exhausts the warm air that the blowing port 41*b* blows to the transportation path 35. That is, the exhaust duct 43 exhausts the warm air blown to and reflected on the web paper WP transported on the transportation path 35. The exhaust duct 43 exhausts the warm air collected outside the inkjet printing unit 2. The exhaust duct 43 is provided upstream of the heater casing 41 along the transportation path 35. Here, the exhaust duct 43 includes the blowing source such as a fan or a blower, not shown, forcibly performing exhaust. Alternatively, the exhaust duct 43 with no blowing source may be adopted as appropriately. Moreover, the exhaust ducts 43 each provided for the warm-air blowing units 33 are integrated to perform exhaust to the outside of the inkjet printing unit 2.

The suction duct 45 supplies air to the blowing fan 39. The suction duct 45 is enclosed with a partition 45*a* so as to flow air inside the suction duct 45. The suction duct 45 is shared with a plurality of warm-air blowing units 33. One end of the suction duct 45 is in communication with the inflow port 41*a* of the heater casing 41 via the blowing fan 39, and the other end is connected to the outside of the inkjet printing unit 2.

Figure 4:
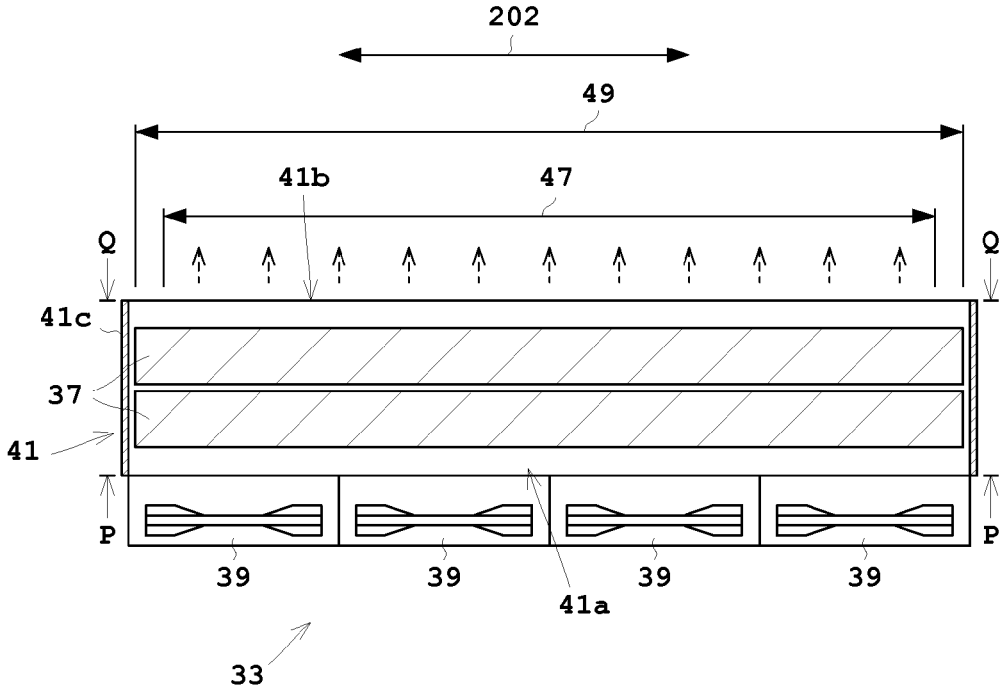
FIG. 4 (*a*) illustrates web paper in a width direction in the warm-air blowing unit, FIG. 4 (*b*) illustrates one example of an inflow port of a heater casing in a P-direction of FIG. 4(*a*), and FIG. 4 (*c*) illustrates one example of a blowing port of the heater casing in a Q-direction of FIG. 4(*a*).
Figure 4:
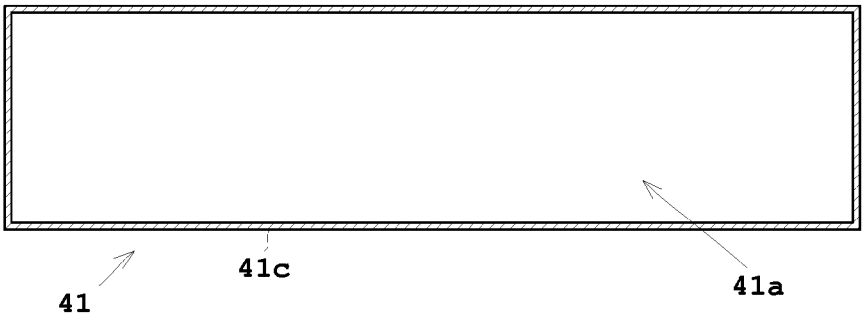
Figure 4:
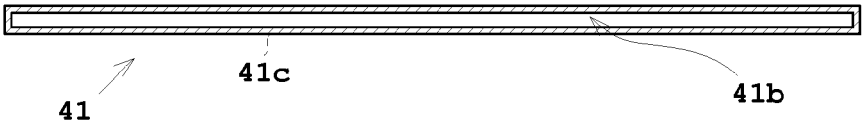

FIG. 4(*a*) illustrates the web paper WP in a width direction 202 in the warm-air blowing unit 33. A plurality of heaters 37 elongate in the width direction 202 of the web paper WP is disposed. The heater 37 has a length 49 substantially equal to a length 47 of the web paper WP in the width direction 202. For instance, the length 49 contains the length 47 of the web paper WP in the width direction 202. This allows blowing a uniform quantity of warm air in the width direction 202 of the web paper WP. The three heaters 37 in FIG. 3 are preferably formed individually. Alternatively, a plurality of heaters 37 may be disposed in the width direction 202 of the web paper WP. Moreover, a plurality of warm-air blowing units 33 has the length 49 in the width direction 202 of the web paper WP, the length 49 containing the length 47 of the web paper WP in the width direction 202.

A plurality of blowing fans 39 is preferably disposed in the width direction 202 of the web paper WP. This allows blowing a uniform quantity of air in the width direction 202 of the web paper WP. Here, one blowing fan 39 may be adopted as necessary. The heater casing 41 encloses the heaters 37. The heater casing 41 includes the inflow port 41*a* (see FIG. 4(*b*)) elongated in the width direction 202 of the web paper WP, and the blowing port 41*b* (see FIG. 4(*c*)) having a slit opening elongated in the width direction 202 of the web paper WP. Here, the inflow port 41*a* may be open only at an inflow portion into which the air from the blowing fan 39 blows.

Moreover, a plurality of warm-air blowing units 33 is disposed along the transportation path 35 of the web paper WP. The number of warm-air blowing units 33 is not limited to six as in FIG. 2, but is set depending on ease in drying of the ink droplets on the web paper WP.

Description will be given next of operation of the drying unit 19 in the inkjet printing apparatus 1. Reference is made to FIG. 1. The web paper WP is transported by the drive rollers 7, 9, 15, and the heat drum 31 (see FIG. 2). When the web paper WP passes through the print unit 17, the inkjet heads 23 discharge ink droplets to perform printing to the web paper WP. In this state, the ink droplets are not fixed on the web paper WP. The web paper WP with the ink droplets adhering thereto is transported to the drying unit 19.

In the drying unit 19 illustrated in FIG. 2, the web paper WP is transported with the back face thereof contacting the heat drum 31 and being wound on the outer edge 31*a* of the heat drum 31. At this time, the heat drum 31 is heated to a temperature set in advance. Accordingly, the web paper WP is heated with the heat drum 31 from the back face thereof. This achieves drying of the ink droplets adhering to the web paper WP. At the same time, the warm-air blowing unit 33 facing the transportation path 35 where the web paper WP is transported dries the ink droplets adhering to the web paper WP.

The heaters 37 are heated to a temperature set in advance. The heaters 37 are enclosed with the heater casing 41. Consequently, air heated with the heaters 37 is accumulated, achieving efficient air heating. The blowing fan 39 blows air into the inflow port 41*a* of the heater casing 41 enclosing the heaters 37. Accordingly, the air heated with the heaters 37 and accumulated is blown from the blowing port 41*b* of the heater casing 41 to the transportation path 35. This achieves drying of the ink droplets adhering to the front face of the web paper WP passing on the transportation path 35.

Moreover, the heater casing 41 is constituted such that the partition 41*c* becomes narrower in the direction along the transportation path 35 toward the blowing port 41*b*. Consequently, the air (warm air) heated with the heaters 37 and accumulated is narrowed through the blowing port 41*b* of the heater casing 41. The narrowed warm air is blown to an area elongated in the width direction 202 of the web paper WP.

The warm air narrowed through the blowing port 41*b* obtains an increased velocity thereof. Moreover, the warm air narrowed through the blowing port 41*b* causes the narrowed warm air elongated in the width direction 202 of the web paper WP. This allows the warm air to be supplied efficiently to a desired position, and achieves uniform quantity distribution and uniform heat-quantity supply of warm air. Moreover, a plurality of blowing fans 39 is disposed in the width direction 202 of the web paper WP. This achieves an increased quantity of air and uniform quantity distribution of warm air. The heater 37 having the substantially same length as the length 47 in the width direction 202 of the web paper WP obtains more uniform quantity of warm air.

The heater 37 faces the transportation path 35 where the web paper WP is transported. The heater 37 is disposed closer to the transportation path 35 than the heater 137 outside the conventional inkjet printing unit 102. This suppresses heat loss. In addition, the blowing fan 39 is disposed at the inflow port 41*a* of the heater casing 41. FIG. 3 illustrates the blowing fan 39 opposite to the transportation path 35 across the heater 37. The heater 37 becomes closer to the transportation path 35 than the blowing source 339 outside the conventional inkjet printing unit 302. This suppresses pressure loss.

The warm-air blowing unit 33 narrows and blows the warm air heated with the heater 37 in the direction along the transportation path 35. The warm air is dried depending on the velocity, the quantity, and the heat quantity of the warm air. Especially, a higher velocity is effective for drying. The warm air with moisture that is blown to and reflected on the web paper WP is collected in the exhaust duct 43 and is exhausted.

As noted above, the heat drum 31 and a plurality of warm-air blowing units 33 perform drying to both back and front faces of the web paper WP. This achieves efficient drying of the ink droplets adhering to the web paper WP. The web paper WP passing through the drying unit 19 then passes through the inspecting unit 21 to the take-up roller 4.

In the drying unit 19 of the inkjet printing apparatus 1 according to the embodiment, the heaters 37 are enclosed with the heater casing 41. Consequently, accumulation of heated air is achieved, leading to effective heating. The blowing fan 39 blows air to the heaters 37 enclosed with the heater casing 41. The heater casing 41 includes the inflow port 41*a*, and the blowing port 41*b* configured to narrow and blow the warm air heated with the heaters 37 to the transportation path 35 outside the heater casing 41 in the direction along the transportation path 35. The warm air is narrowed at the blowing port 41*b*, obtaining an increased velocity thereof. Consequently, a desired air velocity is obtainable even with the slow air from the blowing fan 39. Moreover, the warm air narrowed through the blowing port 41*b* achieves uniform quantity distribution and uniform heat-quantity supply of warm air. The heaters 37 face the transportation path 35 where the web paper WP is transported. Consequently, the heater 37 becomes closer to the transportation path 35 than the conventional external heater 337. This suppresses heat loss. As a result, the heater 37 with low heating power can perform heating efficiently.

Moreover, the drying unit 19 includes the exhaust duct 43 provided outside the heater casing 41 and configured to exhaust the warm air blown from the blowing port 41*b* to the transportation path 35. This achieves exhausting the warm air blown to the transportation path 35 and containing the moisture of the ink droplets. Consequently, efficient drying of the ink droplets is obtainable.

Moreover, the blowing fan 39 is disposed at the inflow port 41*a* of the heater casing 41. This achieves a relatively shorter distance to the transportation path 35 than that from the conventional blowing source 339 provided outside the inkjet printing unit 102, thereby suppressing the pressure loss. Moreover, the blowing fan 39 is disposed at the inflow port 41*a* of the heater casing 41. Accordingly, the heaters 37 are enclosed with the heater casing 41 and the blowing fan 39. This achieves sufficient accumulation of the heated air, leading to efficient heating.

Moreover, the drying unit 19 includes the heat drum 31 opposite to the blowing port 41*b* across the transportation path 35 where the web paper WP is transported. The heat drum 31 heats the back face of the web paper WP to dry the ink droplets adhering to the web paper WP. The blowing port 41*b* blows the warm air to the front face of the web paper WP. The blowing port 41*b* blows the warm air to the front face of the web paper WP with the ink droplets adhering thereto, thereby drying the ink droplets. At the same time, the heat drum 31 opposite to the blowing port 41*b* across the transportation path 35 heats the back face of the web paper WP. This achieves efficient drying of the ink droplets.

Moreover, the exhaust duct 43 is disposed upstream of the heater casing 41 along the transportation path 35. The heater casing 41 includes the blowing port 41*b* so as to blow the warm air obliquely from downstream to upstream sides of the transportation path 35. This achieves an enhanced relative speed of the web paper WP transported on the transportation path 35 and the warm air from the blowing port 41*b*. Consequently, efficient drying of the ink droplets is obtainable.

The drying unit 19 includes a plurality of warm-air blowing units 33 along the transportation path 35. The warm-air blowing units 33 each have the heaters 37, the blowing fan 39, and the heater casing 41. That is, a plurality of warm-air blowing units 33 is disposed along the transportation path 35 of the web paper WP. It is considered that one example of enhancing a drying ability includes making high output of the heaters 37 and the blowing fan 39 in one warm-air blowing unit 33. However, a plurality of warm-air blowing units 33 along the transportation path 35 achieves arrangement of a larger number of heaters 37 and blowing fans 39 closer to the transportation path 35. This obtains reduced heat loss and reduced pressure loss.

In addition, reduced heat loss and pressure loss of the warm air is obtainable and uniform quantity distribution and uniform heat-quantity supply of warm air is achieved. Consequently, the drying unit 19 allows amore sufficient drying effect with its simple and inexpensive construction.

EMBODIMENT 2

Figure 5:
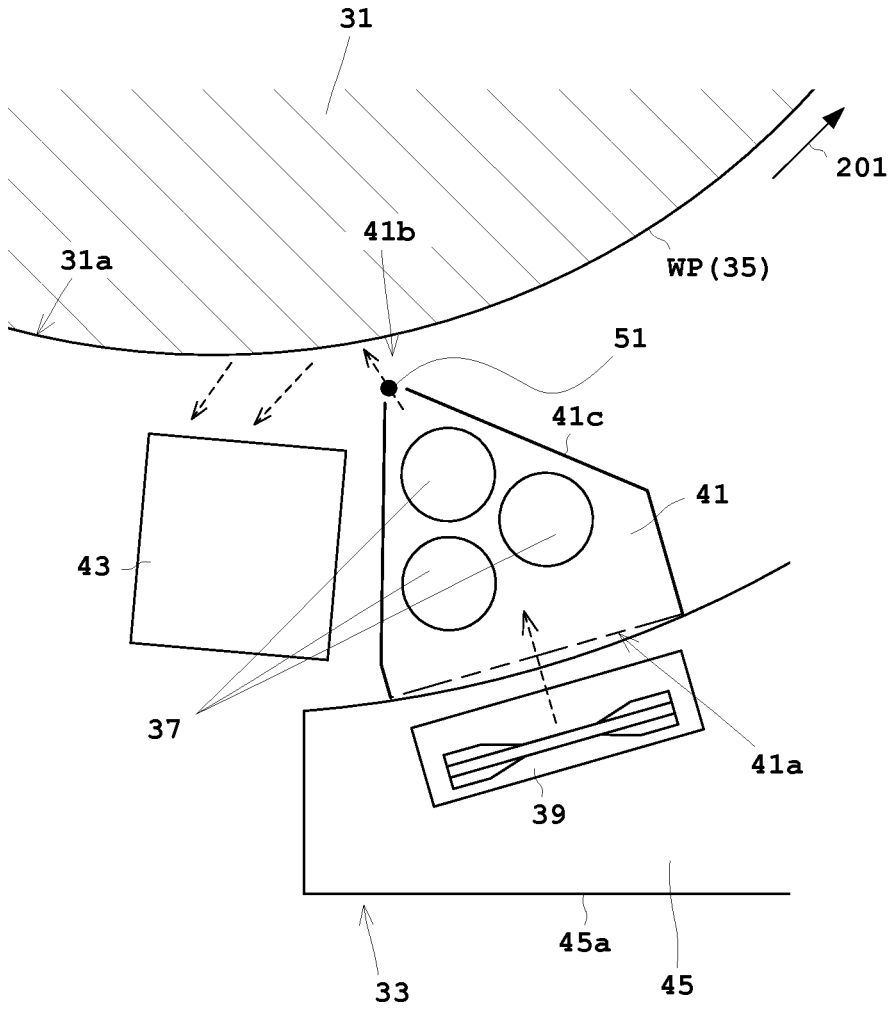
FIG. 5 is a warm-air blowing unit of a drying unit according to Embodiment 2.
Figure 6:
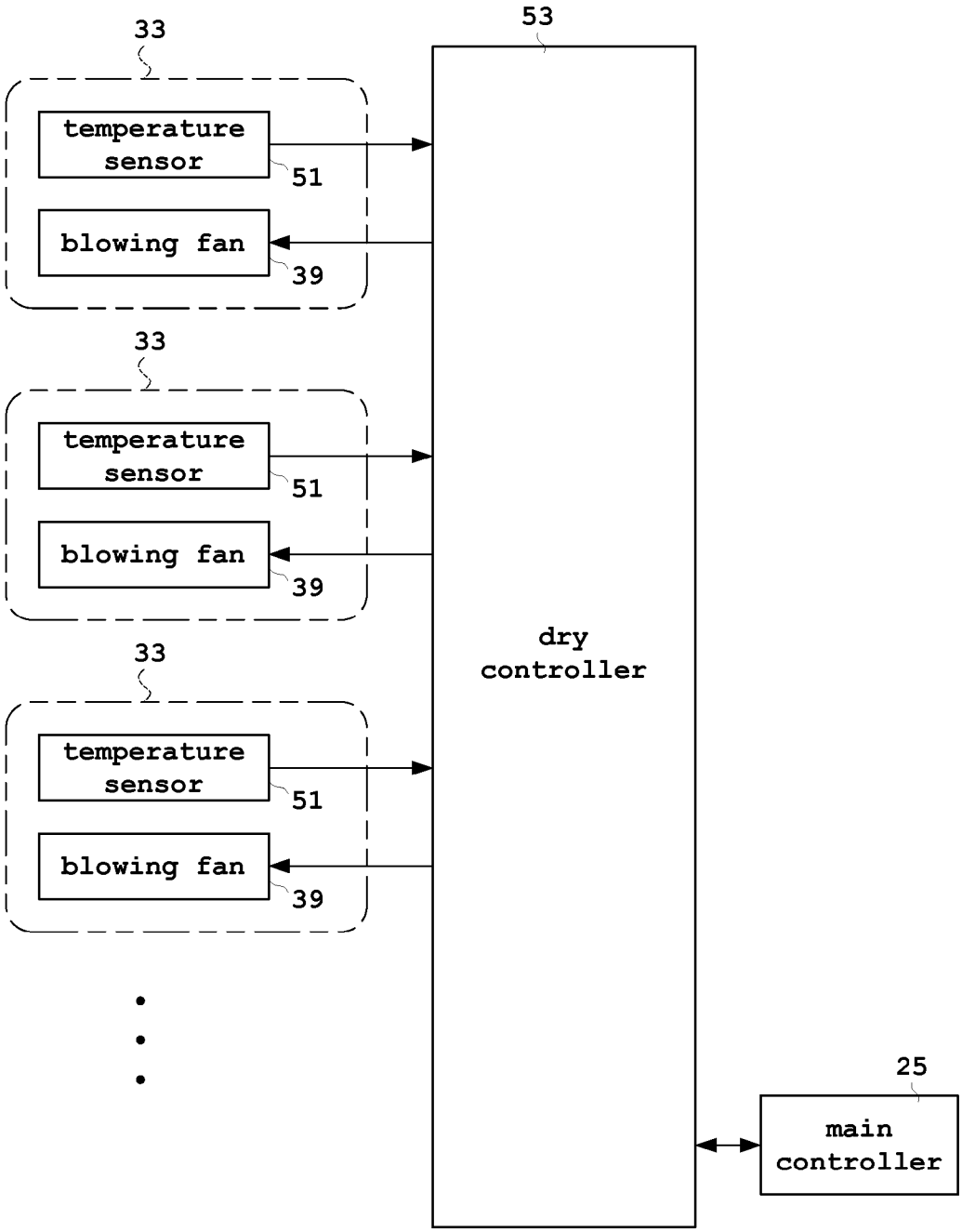
FIG. 6 is a block diagram illustrating a relationship between the warm-air blowing unit and a dry controller according to the embodiment.
Figure 7:
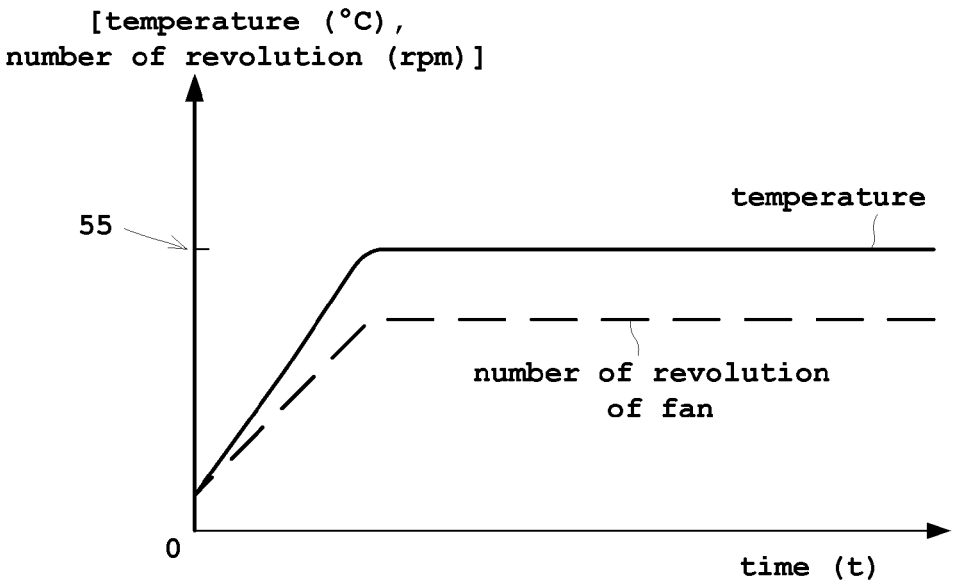
FIGS. 7 (*a*) and (*b*) are each explanatory views of control according to the embodiment.
Figure 7:
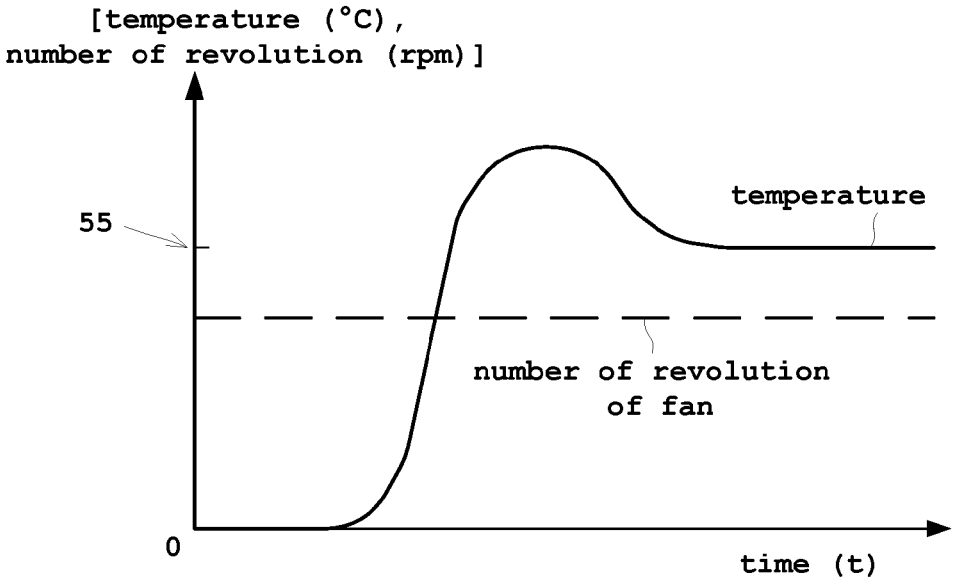

Description will be given next of Embodiment 2 of the present invention with reference to drawings. FIG. 5 illustrates a warm-air blowing unit of a drying unit according to Embodiment 2. FIG. 6 illustrates a relationship between the warm-air blowing unit and a dry controller according to the embodiment. FIGS. 7(*a*) and (*b*) are each explanatory views of control according to the embodiment. Here, the description common to that of Embodiment 1 is to be omitted.

This embodiment includes the following construction in addition to that of Embodiment 1. The drying unit 19 includes a temperature sensor 51 configured to measure a temperature of warm air, and a dry controller 53 configured to control the drying unit 19.

As illustrated in FIG. 5, the temperature sensor 51 is provided at a blowing port 41*b* of a heater casing 41. That is, the temperature sensor 51 may be provided inside or outside the heater casing 41 as long as it is adjacent to the blowing port 41*b*. Alternatively, the temperature sensor 51 may contact a partition 41*c*, or may be spaced away from the partition 41*c*.

Here, the temperature sensor 51 is composed of a thermocouple, for example, but may be composed of a thermistor and the like.

In the drying unit 19, the dry controller 53 controls the heat drum 31 and a plurality of warm-air blowing units 33. The dry controller 53 controls the heaters 37 and the blowing fan 39 in the warm-air blowing unit 33. The dry controller 53 controls a quantity of air from the blowing fan 39 in accordance with the temperature measured with the temperature sensor 51. The dry controller 53 performs control such that the quantity of air from the blowing fan 39 becomes smaller as the temperature measured with the temperature sensor 51 decreases. Moreover, as illustrated in FIG. 6, the temperature sensor 51 is disposed in each of the warm-air blowing units 33. The dry controller 53 controls the blowing fan 39 for each of the warm-air blowing units 33.

Reference is now made to FIGS. 7(*a*) and 7(*b*). In FIGS. 7(*a*) and 7(*b*), a longitudinal axis represents a temperature (° C.) measured with the temperature sensor 51, and a quantity of air from the and blowing fan 39, i.e., a number of revolution (rpm). A horizontal axis represents time (t). Moreover, solid lines represent variations in temperature, whereas dotted lines represent variations in number of revolution of the blowing fan 39.

As illustrated in FIG. 7(*a*), when the heater 37 starts heating and thus a temperature is low at a rising time (t=0) of the warm-air blowing unit 33, for example, the blowing fan 39 is made to rotate at a low number of revolution. Then, the blowing fan 39 is made to rotate at a higher number of revolutions as the temperature of the heater 37 increases. When the temperature reaches a temperature set in advance (e.g., 100° C., denoted by a numeral 55), the blowing fan 39 is made to rotate constantly. On the other hand, as illustrated in FIG. 7(*b*), the heaters 37 start heating at the rising time (t=0) of the warm-air blowing unit 33 while the blowing fan 39 has a constant number of revolution. In this case, the temperature does not rise continuously for a certain period of time, and thereafter the temperature rises to reach a temperature of 55° C. set in advance. That is, as illustrated in FIG. 7(*a*), the dry controller 53 controls the quantity of air from the blowing fan 39 so as to be lower as the temperature measured with the temperature sensor 51 decreases. This achieves rapid rising of the warm-air blowing unit 33.

In the above description, one temperature sensor 51 is disposed in one warm-air blowing unit 33 along the width direction 202 of the web paper WP. Alternatively, a plurality of temperature sensors 51 may be disposed in the width direction 202 of the web paper WP. In this case, the dry controller 53 may control the quantity of air from the blowing fan 39 in accordance with a representative value, such as an average value, the maximum value, or the minimum value of the measured temperature. Alternatively, the temperature sensors 51 may be disposed individually for a plurality of blowing fans 39 in one warm-air blowing unit 33.

The drying unit 19 in inkjet printing apparatus 1 according to the embodiment includes the temperature sensor 51 disposed at the blowing port 41*b*, and the dry controller 53 configured to control a quantity of air from the blowing fan 39 in accordance with a temperature measured with the temperature sensor 51. The dry controller 53 controls the quantity of air from the blowing fan 39 so as to be lower as the temperature measured with the temperature sensor 51 decreases. This causes the temperature of the warm air from the blowing port 41*b* to rise rapidly to a temperature set in advance.

EMBODIMENT 3

Figure 8:
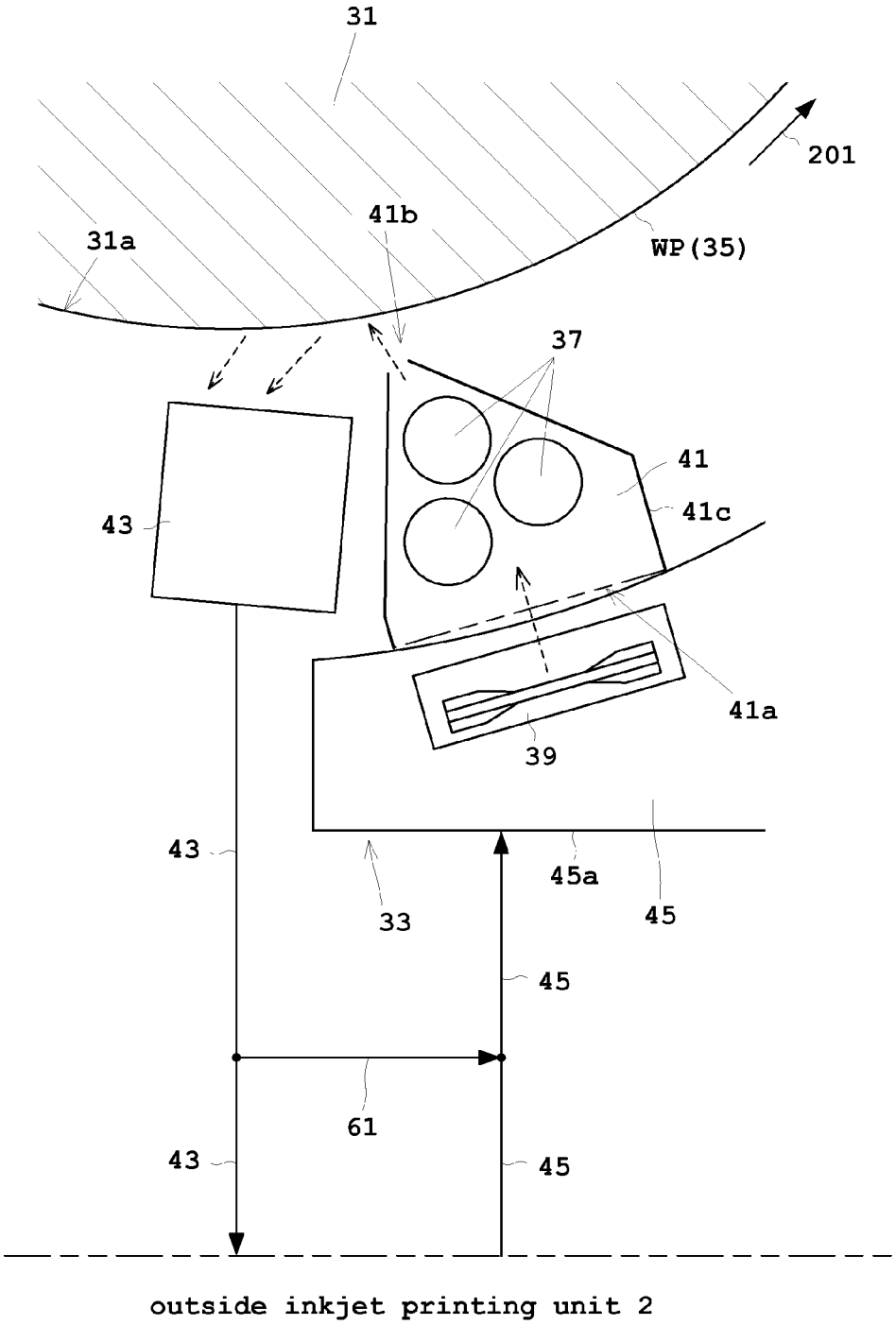
FIG. 8 illustrates a warm-air blowing unit of a drying unit according to Embodiment 3.

Description will be given next of Embodiment 3 of the present invention with reference to drawings. FIG. 8 illustrates a warm-air blowing unit of a drying unit according to the embodiment. Here, the description common to that of Embodiments 1 and 2 is to be omitted.

This embodiment includes the following construction in addition to the constructions in Embodiments 1 and 2. Specifically, as illustrated in FIG. 8, the warm-air blowing unit 33 includes a warm-air circulating duct 61 between the exhaust duct 43 and the suction duct 45. The warm-air circulating duct 61 supplies the warm air collected in the exhaust duct 43 to the suction duct 45. The warm-air circulating duct 61 corresponds to the warm-air circulator in the present invention.

Outside air (fresh air) from outside the inkjet printing unit 2 and the warm air collected in the exhaust duct 43 from the warm-air circulating duct 61 are supplied into the suction duct 45. For instance, 50% of the warm air collected in the exhaust duct 43 is exhausted, and the remaining 50% is circulated. In this case, the blowing source, such as a fan, is disposed for at least either the exhaust duct 43 or the warm-air circulating duct 61. Here, a shape of each duct is adjusted.

The drying unit 19 of the inkjet printing apparatus 1 according to the embodiment includes the suction duct 45 configured to supply air to the blowing fan 39, and the warm-air circulating duct 61 between the exhaust duct 43 and the suction duct 45. The warm-air circulating duct 61 supplies the warm air collected in the exhaust duct 43 to the suction duct 45. The warm-air circulating duct 61 supplies the warm air, blown to the transportation path 35 and exhausted by the exhaust duct 43, to the suction duct 45 supplying air to the blowing fan 39. Consequently, the heaters 37 do not heat outside air (fresh air) but heat air heated once (warm air), achieving efficient heating.

EMBODIMENT 4

Figure 9:
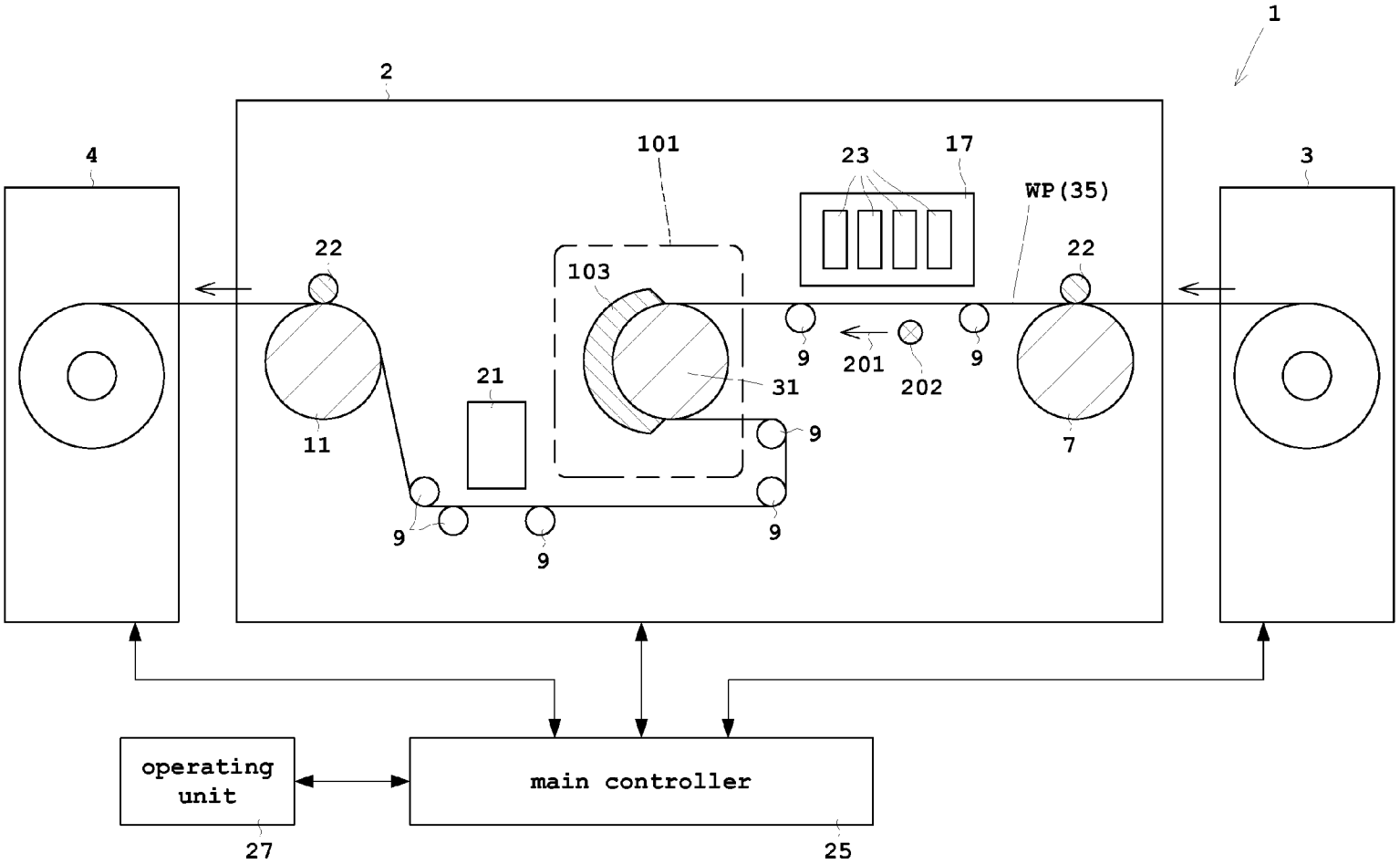
FIG. 9 is a schematic view of an inkjet printing apparatus according to Embodiment 4.
Figure 10:
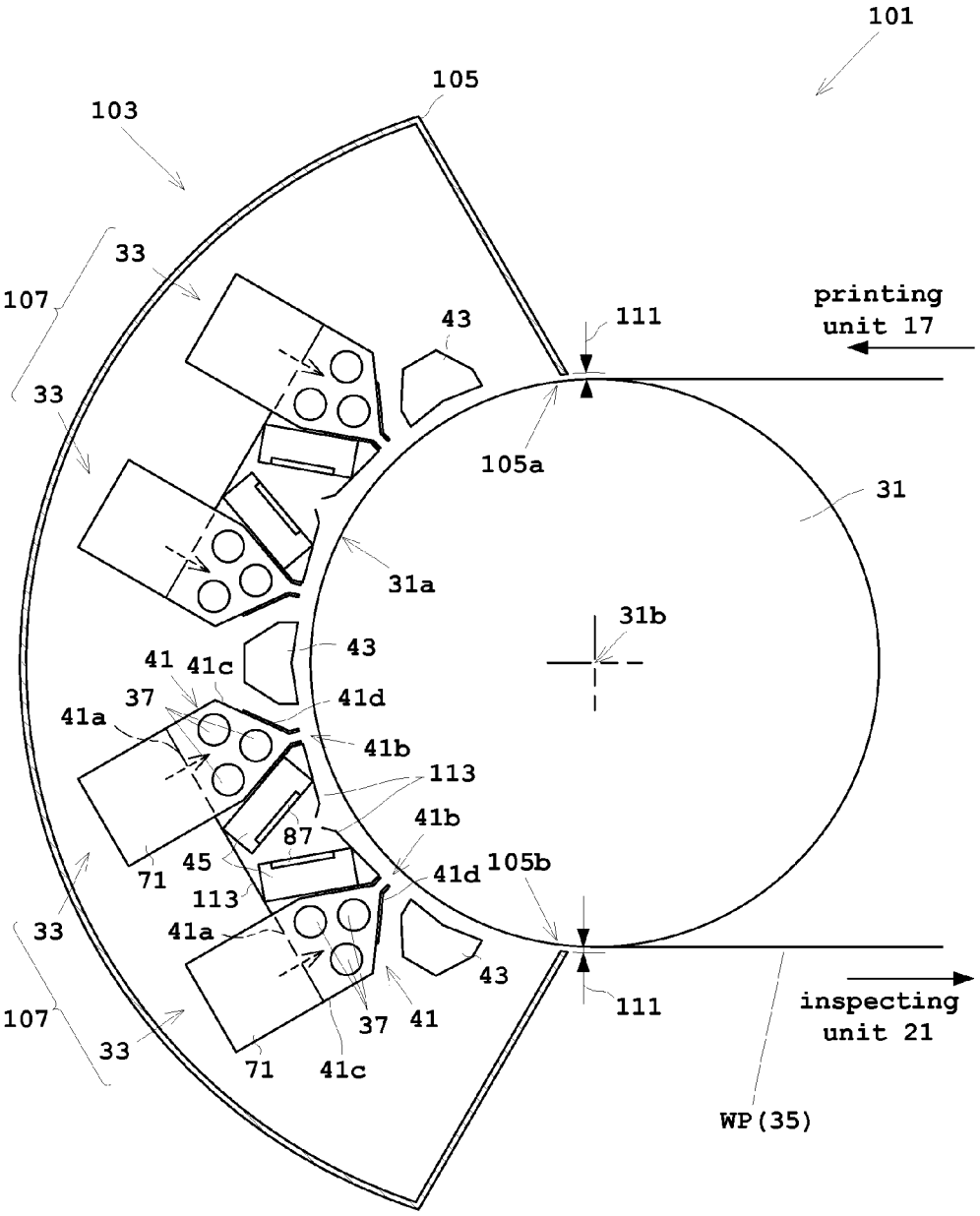
FIG. 10 is a side view of a drying unit according to the embodiment.
Figure 11:
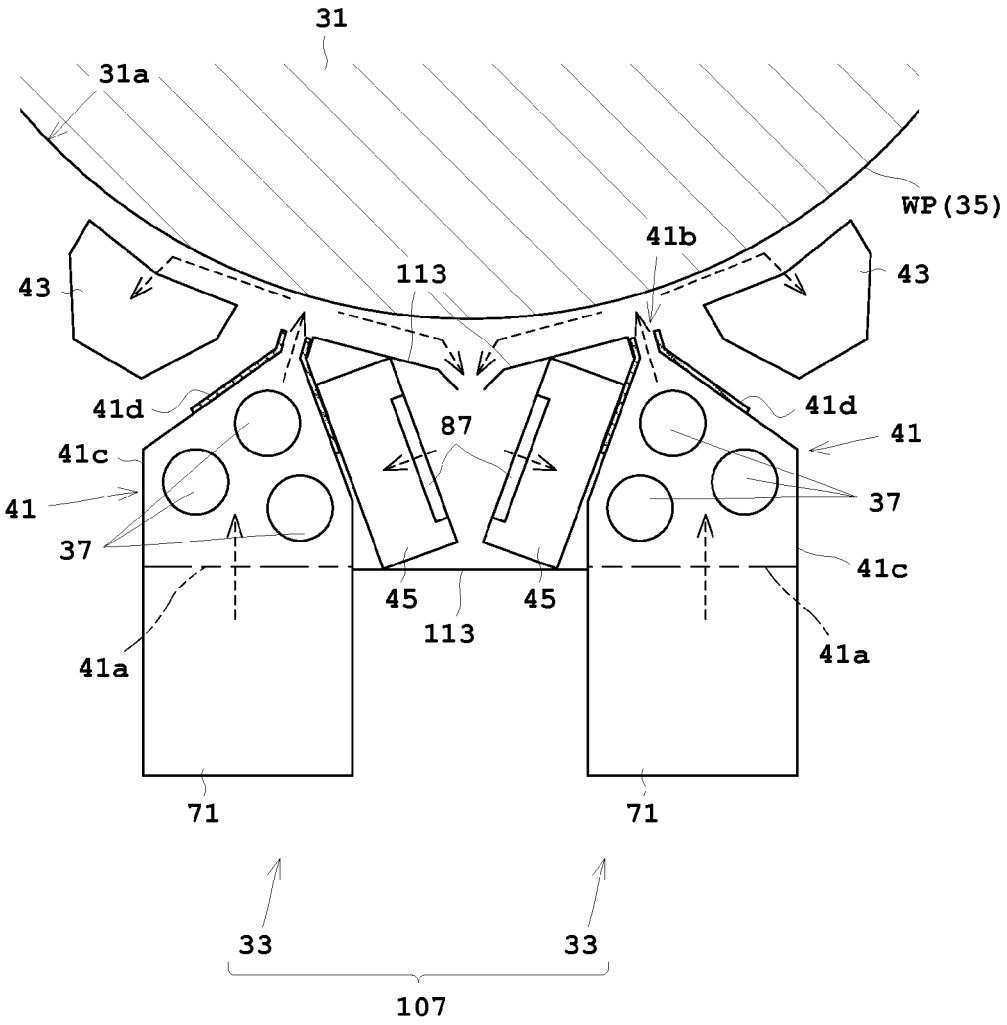
FIG. 11 is a side view of a warm-air blowing unit of the drying unit according to the embodiment.
Figure 12:
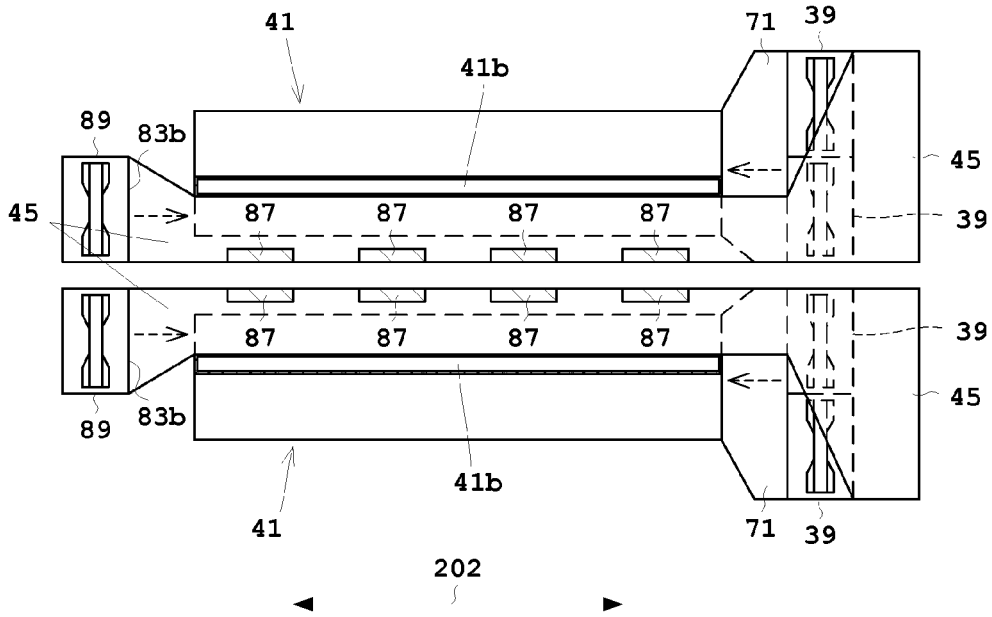
FIG. 12 is a plan view of the warm-air blowing unit of the drying unit according to the embodiment.
Figure 13:
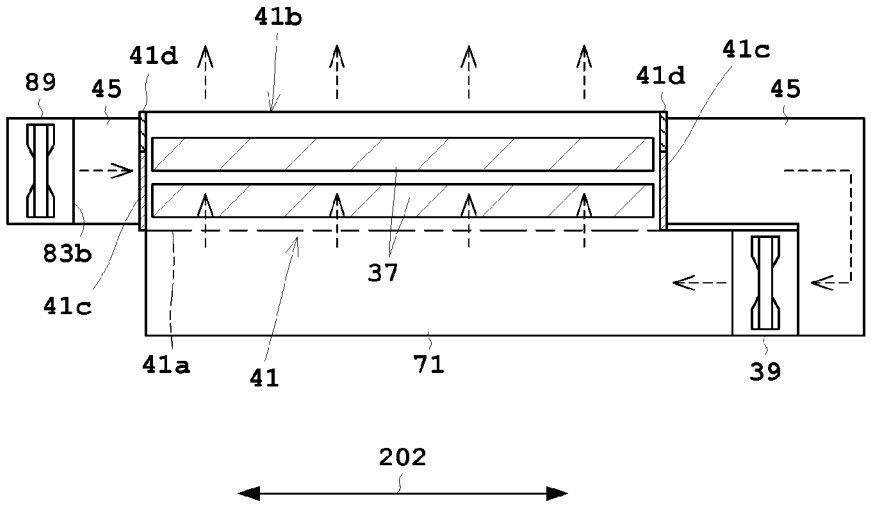
FIG. 13 is a longitudinal sectional view of FIG. 4 illustrating the warm-air blowing unit of the drying unit according to the embodiment.

Description will be given next of Embodiment 4 of the present invention with reference to drawings. FIG. 9 is a schematic view of an inkjet printing apparatus according to Embodiment 4. FIG. 10 is a side view of a drying unit according to the embodiment. FIGS. 11 to 13 are a side view, a plan view, and a longitudinal sectional view of FIG. 12, respectively, of a warm-air blowing unit of the drying unit according to the embodiment. Here, the description common to that of Embodiments 1 to 3 is to be omitted partially.

Reference is made to FIG. 9. Description will be given of difference from FIG. 1 of Embodiment 1. Firstly, in FIG. 9, a drying unit 101 includes the heat drum 31 and a static pressure generator 103. Here, the drying unit 101 corresponds to the drying apparatus in the present invention.

Secondary, in FIG. 9, the inkjet printing apparatus 1 fails to include the edge position controller 13 and the drive roller 15 as illustrated in FIG. 1, and accordingly fails to include the transport roller 9 and the nip roller 22 accompanied therewith. However, the inkjet printing apparatus 1 may include the edge position controller 13 and the drive roller 15 as illustrated in FIG. 1.

Drying Unit

Reference is now made to FIGS. 10 and 11. As noted above, the drying unit 101 includes the heat drum 31 and the static pressure generator 103. Here, the heat drum 31 is similar to that in Embodiment 1, and thus the description thereof is to be omitted.

The static pressure generator 103 is disposed opposite to the heat drum 31 across the transportation path 35 where the web paper WP is transported. The static pressure generator 103 generates static pressure by air to the transportation path 35. That is, the static pressure generator 103 presses the web paper WP against the heat drum 31 with the static pressure by air, thereby obtaining a gripping force upon transporting the web paper WP. The static pressure generator 103 includes a housing 105 and a warm-air blowing unit 107. The warm-air blowing unit 107 is formed by a plurality of (e.g., two) adjacent warm-air blowing units 33 as a pair.

The housing 105 partially covers the transportation path 35, i.e., partially covers the outer edge 31*a* of the heat drum 31. A clearance 111 through which the web paper WP can pass is provided between the outer edge 31*a* of the heat drum 31 and the housing 105. The web paper WP enters from an upstream inlet 105*a* of the transportation path 35 into an area covered with the housing 105, and exits the area covered with the housing 105 from a downstream outlet 105*b* of the transportation path 35. Moreover, air (warm air) inside the housing 105 leaks from the clearance 111.

The warm-air blowing unit 33 blows the warm air to the transportation path 35 within the housing 105. A plurality of warm-air blowing units 33 is disposed along the outer edge 31*a* of the heat drum 31, i.e., along the transportation path 35. As illustrated in FIGS. 10 to 13, the warm-air blowing units 33 each include the heaters 37, the blowing fan 39, the heater casing (heater case) 41, and an air-blowing duct 71.

The heaters 37 face the transportation path 35 and heats air. For instance, the heater 37 is formed by a sheathed heater. Alternatively, the heater 37 may be another heat source such as one that generates heat through conduction of electricity. The blowing fan 39 blows air to the heaters 37. The blowing fan 39 has a purpose of blowing warm air. The blowing fan 39 is preferably formed by a combination of a plurality of fans in series, e.g., a counter-rotating fan. Consequently, high setting density of fans and a large quantity of air are obtainable. Accordingly, this causes a property that decrease in quantity and velocity of air is avoidable even when air flows into a place, such as the heater casing 41, with drag. The blowing fan 39 may be another blowing source, such as another type of fans and blowers.

The heater casing 41 encloses the heater 37. The heater casing 41 includes the inflow port 41*a* into which the air from the blowing fan 39 flows, and a nozzle 41*d* configured to narrow and blow the warm air heated with the heaters 37 to the transportation path 35 outside the heater casing 41 in a direction along the transportation path 35. The heater casing 41 is constituted such that the partition 41*c* becomes narrower in the direction along the transportation path 35 toward the blowing port 41*b* at a tip end of the nozzle 41*d*. Here, the heater casing 41 is separated from the nozzle 41*d*. Alternatively, the heater casing 41 and the nozzle 41*d* may be integrated to form the heater casing 41.

The heater casing 41 almost encloses the heater 37 other than the inflow port 41*a*, the blowing port 41*b*, and additionally the nozzle 41*d*. The heater casing 41 is made of a heat resisting material, e.g., a metal such as stainless steel or plastic coated with a heat resisting coating. The blowing port 41*b* is disposed adjacent to the transportation path 35 (for example, by 10 mm). The nozzle 41*d* of the heater casing 41 blows the warm air to the transportation path 35 vertically, i.e., to an axis 31*b* of a rotary shaft of the heat drum 31.

The air-blowing duct 71 is disposed between the blowing fan 39 and the inflow port 41*a* of the heater casing 41. The air-blowing duct 71 blows air from the blowing fan 39 into the inflow port 41*a* of the heater casing 41.

Moreover, the static pressure generator 103 includes the exhaust duct 43 and the suction duct 45. The exhaust duct 43 is disposed outside the heater casing 41. The exhaust duct 43 exhausts the warm air blown to the transportation path 35 through the nozzle 41*d* of the warm-air blowing unit 33. That is, the exhaust duct 43 exhausts the warm air blown to and reflected on the web paper WP transported on the transportation path 35. The exhaust duct 43 exhausts the warm air collected outside the inkjet printing unit 2. Here, the exhaust duct 43 includes a blowing source such as a fan or a blower, not shown, forcibly performing exhaust. Alternatively, the exhaust duct 43 with no blowing source may be adopted as appropriately.

The suction duct 45 supplies air to the warm-air blowing unit 33. The suction duct 45 is used by circulating the warm air collected by a warm-air suction port 87. The warm-air suction port 87 sucks the warm air blown to the transportation path 35 for supplying the warm air to the suction duct 45. Letting a plurality of (e.g., two) adjacent warm-air blowing units being as a pair, the warm-air suction port 87 is disposed between the plurality of (e.g., two) adjacent warm-air blowing units 33. The warm air sucked and collected by the warm-air suction port 87 is supplied through the suction duct 45 to the blowing fan 39. Here, the warm-air suction port 87 corresponds to the warm-air suction unit in the present invention.

As illustrated in FIGS. 12 and 13, the suction duct 45 is provided with an outside-air suction port 83*b* configured to suck air (fresh air) outside the suction duct 45, i.e., outside the inkjet printing unit 2. Moreover, the suction duct 45 is provided with a suction fan 89, adjacent not to warm-air suction port 87 but to the outside-air suction port 83*b*, that is configured to suck outside air. The suction fan 89 is constituted by a fan including a counter-rotating fan or a blower. Here, the suction fan 89 corresponds to the suction-blowing source in the present invention.

The suction fan 89 is set to have a quantity of air smaller than the blowing fan 39. This causes difference in quantity of air between the blowing fan 39 and the suction fan 89. The difference in quantity of air generates a suction force for collecting the warm air from the warm-air suction port 87.

Figure 14:
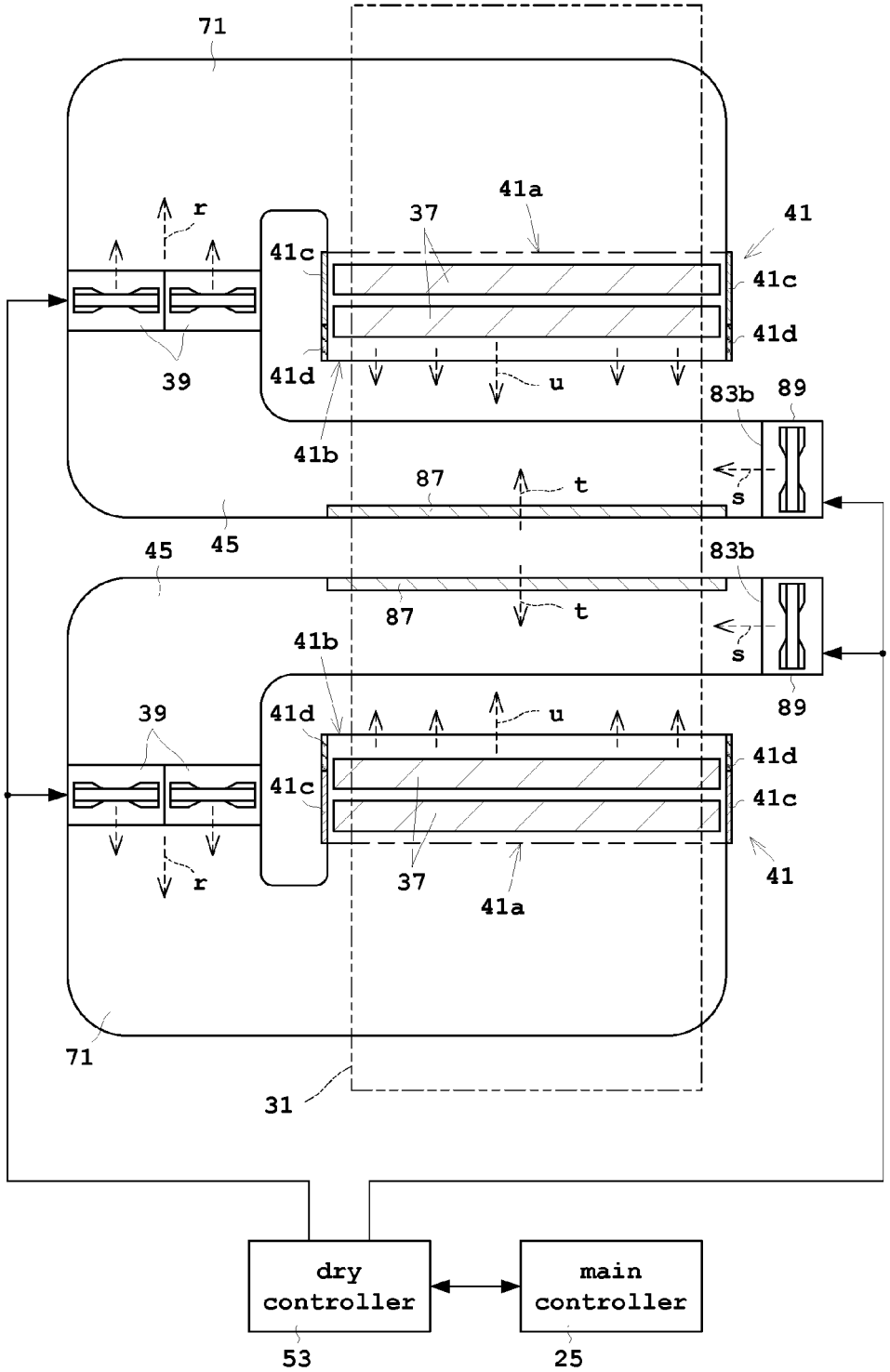
FIG. 14 is an explanatory view of circulation of the warm air in the warm-air blowing unit of the drying unit according to the embodiment.

The blowing fan 39 and the suction fan 89 are controlled by a dry controller 53 (see FIG. 14). The dry controller 53 changes the difference in quantity of air between the blowing fan 39 and the suction fan 89. That is, the dry controller 53 controls the difference in quantity of air from the blowing fan 39 and that from the suction fan 89 by adjusting the number of revolutions of the fans. This achieves variation in mixing ratio of the warm air to be circulated. Here, the dry controller 53 controls the heat drum 31 and the static pressure generator 103.

As illustrated in FIGS. 12 and 13, a plurality of elongated heaters 37 is disposed in the width direction 202 of the web paper WP. The heater 37 has a length larger than or equal to that of the web paper WP in the width direction 202. This achieves blowing a uniform heat quantity of warm air in the width direction 202 of the web paper WP. The heater casing 41 encloses the heaters 37. The heater casing 41 includes the inflow port 41*a* elongated in the width direction 202 of the web paper WP, and the blowing port 41*b* having a slit opening elongated in the width direction 202 of the web paper WP.

The suction duct 45 is disposed in the width direction 202 of the web paper WP and includes warm-air suction ports 87 in the width direction 202 of the web paper WP. Moreover, the suction duct 45 contacts the heater casing 41. This achieves heating air through the suction duct 45.

Here in FIGS. 10 and 11, a warm-air sucking guide plate configured to suck the warm air is denoted by a numeral 113. Moreover, the warm-air blowing unit 107 includes the suction duct 45, the outside-air suction port 83*b*, and the suction fan 89 in addition to a plurality of (e.g., two) adjacent warm-air blowing units 33. Alternatively, the warm-air blowing unit 107 may also include the warm-air sucking guide plate 113 and the exhaust duct 43.

Description will be given next of operation of the drying unit 101 in the inkjet printing apparatus 1. Reference is made to FIG. 9. The web paper WP is transported by the drive rollers 7, 11, and the heat drum 31. When the web paper WP passes through the print unit 17, the inkjet heads 23 discharges ink droplets to perform printing to the web paper WP. In this state, the ink droplets are not fixed on the web paper WP. The web paper WP with the ink droplets adhering thereto is transported to the drying unit 101.

In the drying unit 101 illustrated in FIG. 10, the web paper WP is transported with the back face thereof contacting the heat drum 31 and being wound on the outer edge 31*a* of the heat drum 31. At this time, the heat drum 31 is heated to a temperature set in advance. Accordingly, the back face of the web paper WP is heated with the heat drum 31. This achieves drying of the ink droplets adhering to the web paper WP. At the same time, the two warm-air blowing units 107 (i.e., four warm-air blowing units 33) dry the ink droplets adhering to the web paper WP from the front face of the web paper WP.

The warm-air blowing unit 33 blows the warm air to the transportation path 35 within the housing 105. Consequently, the warm air is blown to a face (front face) to which the ink droplets of the web paper WP adhere, whereby the ink droplets adhering to the web paper WP can be dried. Moreover, the exhaust duct 43 exhausts the warm air blown to the transportation path 35, causing flow of the warm air within the housing 105. This achieves drying the ink droplets adhering to the web paper WP within the housing 105 of the static pressure generator 103 by applying a large quantity of air to the web paper WP.

On the other hand, in the static pressure generator 103, the warm air is blown within the housing 105. This achieves the housing 105 having an internal pressure higher than an external pressure, generating static pressure. Consequently, the static pressure by air causes the web paper WP to be pressed against the heat drum 31. The static pressure applied by air can prevent the printed matter from being stained. In addition, the web paper WP is pressed with an area larger than the nip roller 22. Accordingly, reduced stress to the printed matter is obtainable than the case with the nip roller under the same pressure.

Description will be given next of operation of the warm-air blowing unit 107. The warm-air blowing unit 107 is used by circulating the warm air blown to the transportation path 35. Accordingly, the warm air other than outside air (fresh air) is adopted. This allows the warm-air blowing unit 33 to blow the warm air effectively.

As illustrated in FIGS. 11 and 13, the heaters 37 are heated to a temperature set in advance. The heaters 37 are enclosed with the heater casing 41. Consequently, air heated with the heaters 37 are accumulated, achieving efficient air heating. The blowing fan 39 blows air through the air-blowing duct 71 into the inflow port 41*a* of the heater casing 41 enclosing the heaters 37.

Moreover, the heater casing 41 is constituted such that the partition 41*c* becomes narrower in the direction along the transportation path 35 toward the blowing port 41*b*. Consequently, the air (warm air) heated with the heaters 37 and accumulated is narrowed through the blowing port 41*b* of the heater casing 41. The narrowed warm air is blown to an area elongated in the width direction 202 of the web paper WP.

The warm-air blowing unit 33 narrows and blows the warm air heated with the heater 37 to an area elongated in the width direction 202 of the web paper WP. The warm air is dried depending on the velocity, the quantity, and the heat quantity of the warm air. Especially, high air velocity is effective for drying. The warm air containing moisture and blown to and reflected on the web paper WP is collected in the exhaust duct 43 and is then exhausted. Here, the temperature of the warm air is detected with a temperature sensor, not shown, disposed at the blowing port 41*b* of the heater casing 41, and is controlled with the dry controller 53.

The suction duct 45 supplies air to the blowing fan 39 of the warm-air blowing unit 33. The outside-air suction port 83*b* provided in the suction duct 45 sucks outside air. Outside air is sucked with the suction fan 89. In addition, the suction duct 45 sucks the warm air blown to the transportation path 35 through the nozzle 41*d* of the warm-air blowing unit 33 by the warm-air suction port 87. A mixing ratio of the outside air and the warm air sucked with the suction fan 89 in the suction duct 45 is changed and then the outside air and the warm air are mixed, whereby a temperature of the warm air to be reused is adjustable. Moreover, changing the mixing ratio of the outside air and the warm air achieves adjustment of the temperature of the warm air blown from the nozzle 41*d* of the warm-air blowing unit 33.

FIG. 14 is an explanatory view of circulation of the warm air by the warm-air blowing unit. For instance, a ratio is assumed of "2" part of an air quantity r to "1" part of an air quantity s, the air quantity r being from the blowing fan 39 and the air quantity s being from the suction fan 89. This causes difference in air quantity between the blowing fan 39 and the suction fan 89. The difference in air quantity generates a suction force at the warm-air suction port 87. When a quantity of warm air t collected in the warm-air suction port 87 becomes "1" part, a mixing ratio of the outside air to the collected warm air can be of 1:1 (i.e., 50%:50%). Since the air quantity from the blowing fan 39 has the ratio of "2" part, the warm air having a mixing ratio "2" part of an air quantity u is blown from the blowing port 41*b* of the heater casing 41.

According to the embodiment, the static pressure generator 103 is disposed opposite to the heat drum 31 across the transportation path 35 where the web paper WP is transported, and generates the static pressure by air to the transportation path 35. The static pressure by air causes the web paper WP to be pressed against the heat drum 31 uniformly, obtaining a gripping force due to rotation of the heat drum 31 upon transporting the web paper WP. In addition, the static pressure by air is generated toward the transportation path 35, preventing staining of the web paper WP.

The warm-air blowing unit 33 includes the nozzle 41*d* configured to narrow and blow the warm air to the transportation path 35 through the slit opening elongated in the width direction 202 of the web paper WP. This achieves an increased velocity of the warm air to be blown. Moreover, any quantity of air is obtainable even with the slow air from the blowing fan 39 of the warm-air blowing unit 33. The warm air is narrowed through the nozzle 41*b*. This achieves uniform quantity distribution and uniform heat-quantity of warm air.

A plurality of (e.g., four) warm-air blowing units 33 is disposed along the transportation path 35. Letting the plurality of (e.g., two) adjacent warm-air blowing units 33 be a pair, the warm-air suction port 87 is disposed between a plurality of (e.g., two) the adjacent warm-air blowing units 33. Entering air into the warm-air suction port 87 from other than the warm-air blowing unit causes decrease in temperature of the warm air to be sucked. However, the warm-air suction port 87 is disposed between a plurality of (e.g., two) adjacent warm-air blowing units 33, i.e., the warm-air suction port 87 is sandwiched with the warm air from the warm-air blowing unit 33, achieving suction of the warm air with high temperatures. Consequently, the warm-air blowing unit 33 allows blowing of the warm air heated efficiently.

Since the blown warm air is reused with the aspects of the warm-air blowing unit 107 illustrated in FIGS. 11 to 13, the power-saved heaters 37 are obtainable.

The warm-air blowing unit 33 includes the heaters 37 facing the transportation path 35, the blowing fan 39 configured to blow warm air to the heaters 37, and the heater casing 41 enclosing the heaters 37. The heater casing 41 includes the inflow port 41*a* into which air from the blowing fan 39 flows, and the nozzle 41*d* configured to narrow and blow the warm air heated with the heaters 37 to the transportation path 35 outside the heater casing 41 in the direction facing the transportation path 35.

The heaters 37 are enclosed with the heater casing 41. Consequently, accumulation of heated air is achieved, leading to effective heating. The blowing fan 39 blows air to the heaters 37 enclosed with the heater casing 41. The heater casing 41 includes the inflow port 41*a*, and the nozzle 41*d*. The nozzle 41*d* narrows and blows the warm air heated with the heaters 37 to the transportation path 35 outside the heater casing 41 in the direction facing the transportation path 35. The warm air is narrowed at the nozzle 41*d*, obtaining an increased velocity thereof. Consequently, a desired air velocity is obtainable even with the slow air from the blowing fan 39. Moreover, the warm air narrowed at the nozzle 41*d* achieves uniform quantity distribution and uniform heat-quantity supply of warm air. The heaters 37 face the transportation path 35 where the web paper WP is transported. Consequently, the heaters 37 are provided closer to the transportation path 35. This suppresses heat loss. As a result, the heaters 37 with low heating power can perform heating efficiently.

The web paper WP is fed from a roll of web paper WP. The heat drum 31 with an insufficient gripping force causes slip of the web paper WP, leading to unstable transportation of the web paper. Consequently, the web paper WP supplied from the roll makes it difficult to control the web paper WP together with the other drive rollers 7, 11 so as to be transported stably. However, the gripping force is obtained with the static pressure generator 103, achieving stable control for transportation.

EMBODIMENT 5

Figure 15:
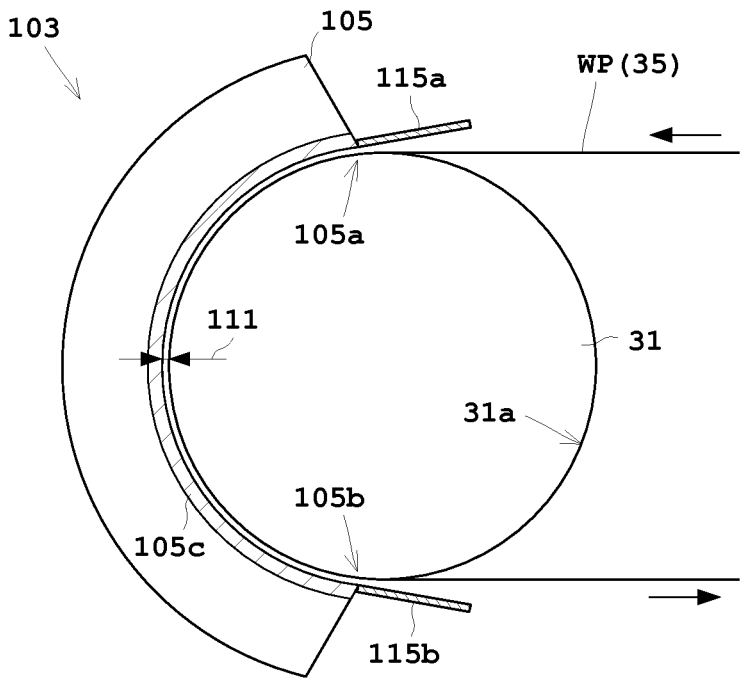
FIG. 15 is a side view of a drying unit according to Embodiment 5.

Description will be given next of Embodiment 5 of the present invention with reference to drawings. FIG. 15 is a side view of a drying unit according to the embodiment. Here, the description common to that of Embodiment 4 is to be omitted.

A housing 105 according to Embodiment 5 includes, in addition to the construction of Embodiment 4, a static-pressure adjusting device configured to maintain the static pressure during passing the web paper WP through the housing 105 by at least either gradually increasing the static pressure at the inlet 105*a* of the housing 105 or gradually decreasing the static pressure at the outlet 105*b* of the housing 105.

As illustrated in FIG. 15, a guide plate 115*a* as the static pressure adjusting device is provided that extends beyond the housing 105 for gradually increasing the static pressure at the inlet 105*a* of the housing 105. Moreover, a guide plate 115*b* is provided that extends beyond the housing 105 for gradually decreasing the static pressure at the outlet 105*b* of the housing 105. This achieves gradual increase and decrease of the static pressure upon passing the web paper WP through the housing 105. Consequently, maintained static pressure within the housing 105 is obtainable.

Moreover, a punching metal with many holes may be provided partially (e.g., adjacent to the inlet 105*a* or the outlet 105*b*) or entirely on an arc area 105*c* where the housing 105 covers the transportation path 35. The punching metal may avoid reduction of pressure through suppressing passage of air. The punching metal is provided to the extent that the warm-air blowing unit 33 does not lose its function. The punching metal maintains the static pressure through variations in number or size of holes.

Moreover, the housing 105 may include the guide plates 115*a*, 115*b* together with the punching metal. In FIG. 15, a clearance 111 is provided between the heat drum 31 and the housing 105. Here, the housing 105 is constituted such that almost no leakage of air (warm air) to the heat drum 31 occurs on front and rear sides of the sheet of FIG. 15.

The present invention is not limited to the foregoing examples, but may be modified as follows.

Figure 16:
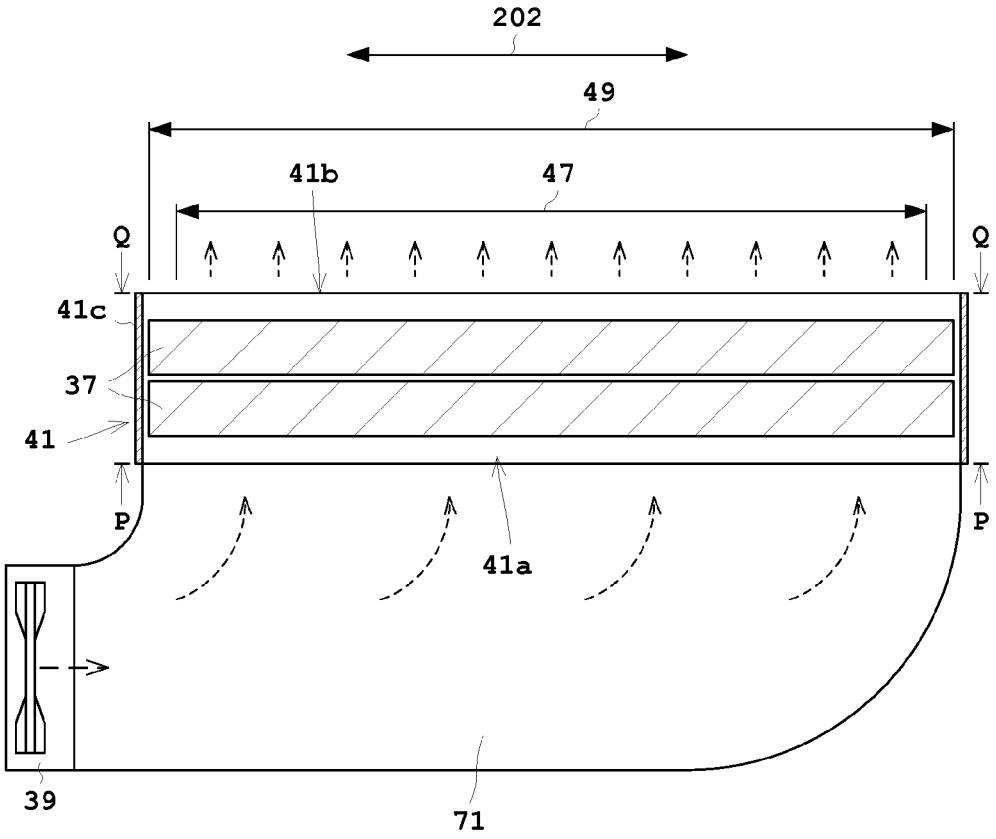
FIG. 16 illustrates web paper in a width direction in a warm-air blowing unit according to one modification.

(1) In Embodiments 1 to 3 mentioned above, the blowing fan 39 in FIG. 3, for example, is provided at the inflow port 41*a* of the heater casing 41. Alternatively, as illustrated in FIG. 16, the air-blowing duct 71 may be disposed between the inflow port 41*a* of the heater casing 41 and the blowing fan 39 for blowing air from a position spaced away. In this case, the air-blowing duct 71 blows air uniformly in the width direction 202 of the web paper WP at the inflow port 41*a* of the heater casing 41. The blowing fan 39 is disposed inside the inkjet printing unit 2. Alternatively, the blowing fan 39 may be disposed outside the inkjet printing unit 2 as necessary. This causes increased pressure loss depending on a distance between the inflow port 41*a* of the heater casing 41 and the blowing fan 39, i.e., the length of the air-blowing duct 71. On the other hand, heat loss can be suppressed to obtain uniform quantity distribution and uniform heat-quantity of warm air.

Figure 17:
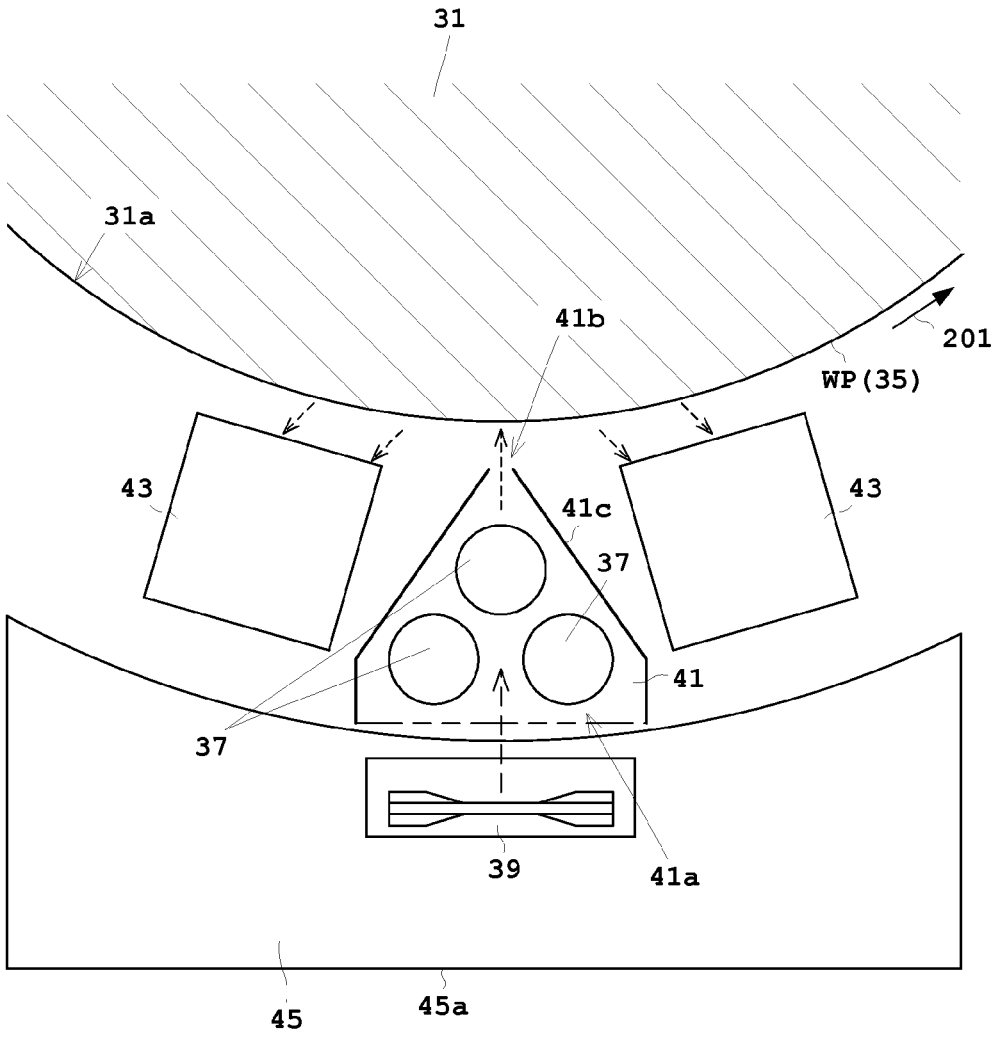
FIG. 17 illustrates a warm-air blowing unit of a drying unit according to one modification.

(2) According to Embodiments 1 to 3 and the modification (1) mentioned above, the exhaust duct 43 in FIG. 3, for example, is disposed upstream of the heater casing 41 along the transportation path 35. Moreover, the heater casing 41 is provided with the blowing port 41*b* configured to blow the warm air obliquely from downstream to upstream sides of the transportation path 35. Alternatively, the construction as illustrated in FIG. 17 may be adopted. The exhaust ducts 43 are disposed on upstream and downstream sides of the transportation path 35 across the heater casing 41. Moreover, the heater casing 41 is provided with the blowing port 41*b* so as to blow the warm air vertically to the transportation path 35. This ensures to blow the warm air in the front direction of the web paper WP transported on the transportation path 35.

(3) According to Embodiments 1 to 3 and the modification (1) mentioned above, the exhaust duct 43 in FIG. 3, for example, is disposed upstream of the heater casing 41 along the transportation path 35. Moreover, the heater casing 41 is provided with the blowing port 41*b* so as to blow the warm air obliquely from downstream to upstream sides of the transportation path 35. Alternatively, a position of the exhaust duct 43 and the heater casing 41 (including the heater 37 and the blowing fan 39) may be reversed as necessary.

Figure 18:
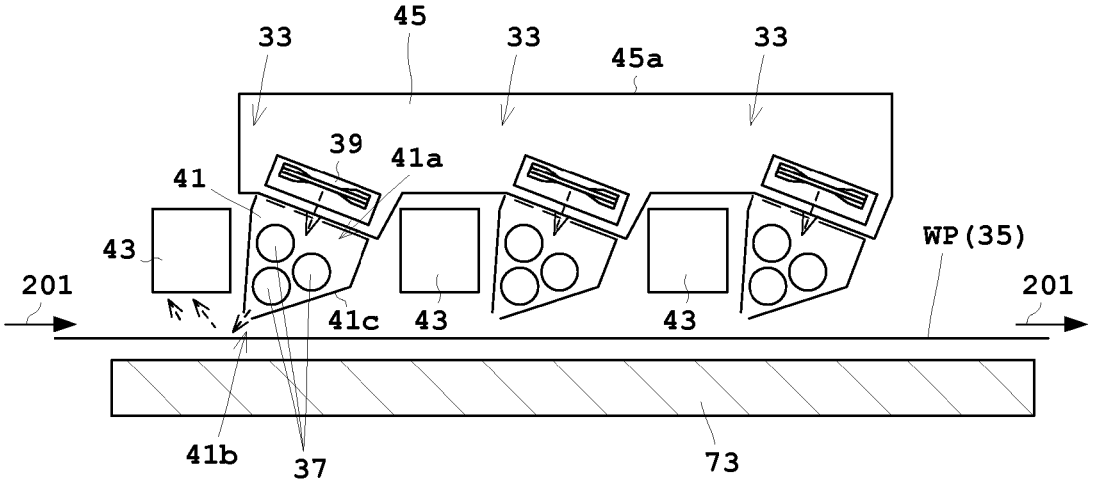
FIG. 18 illustrates a back-face drying unit of a drying unit according to one modification.

(4) According to Embodiments 1 to 3 and the modifications (1) to (3) mentioned above, a plurality of warm-air blowing units 33 is disposed along the transportation path 35. The heat drum 31 is disposed opposite to the plurality of warm-air blowing units 33 across the transportation path 35. The heat drum 31 heats the back face of the web paper WP to dry the ink droplets adhering to the web paper WP. Alternatively, instead of the heat drum 31, a flat plate heater 73 as illustrated in FIG. 18 may be provided as the back-face drying unit. In this case, a plurality of warm-air blowing units 33 is to be disposed along a line transportation path 35.

Figure 19:
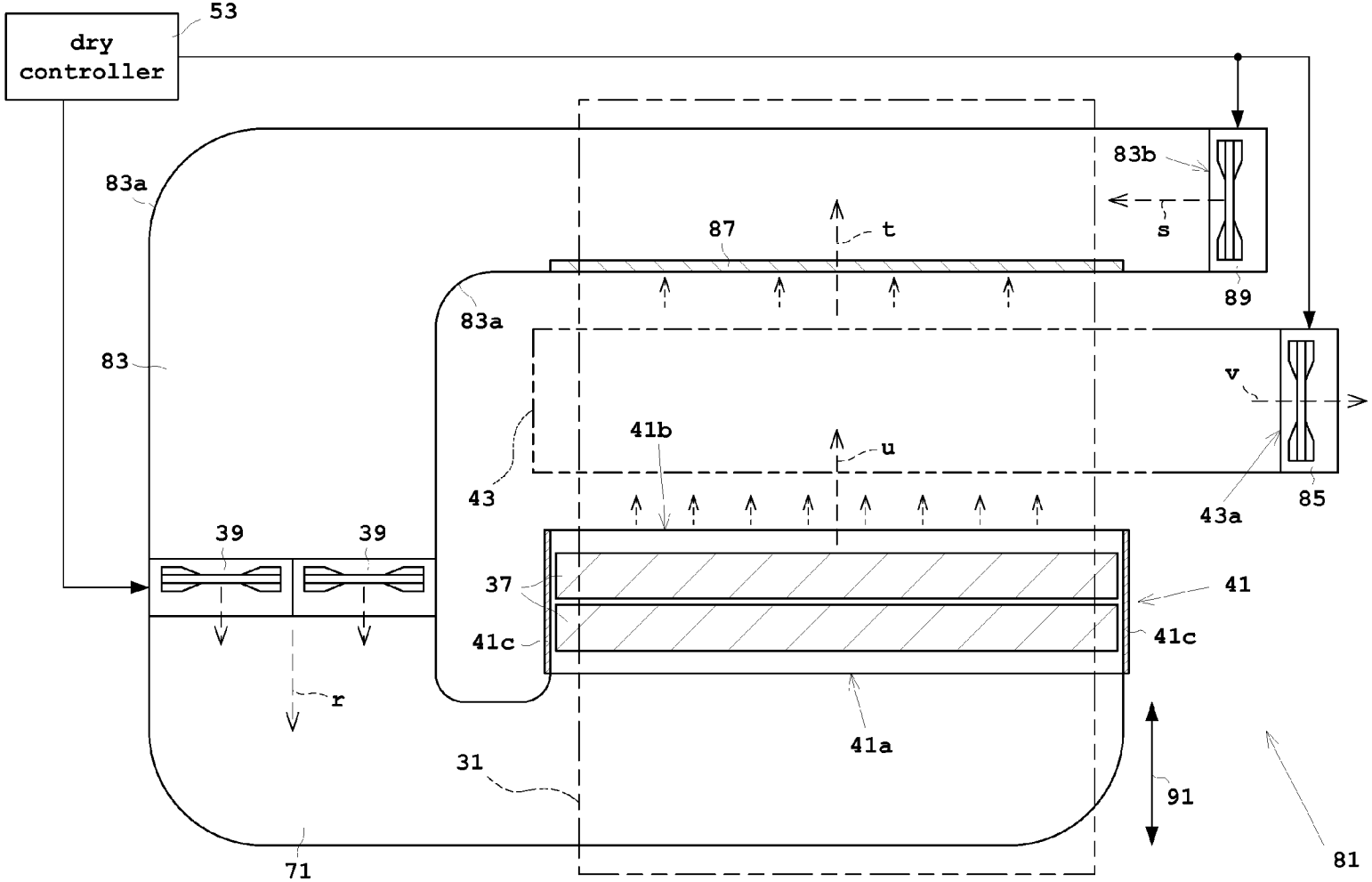
FIG. 19 illustrates a warm-air blowing unit of a drying unit according to one modification.
Figure 20:
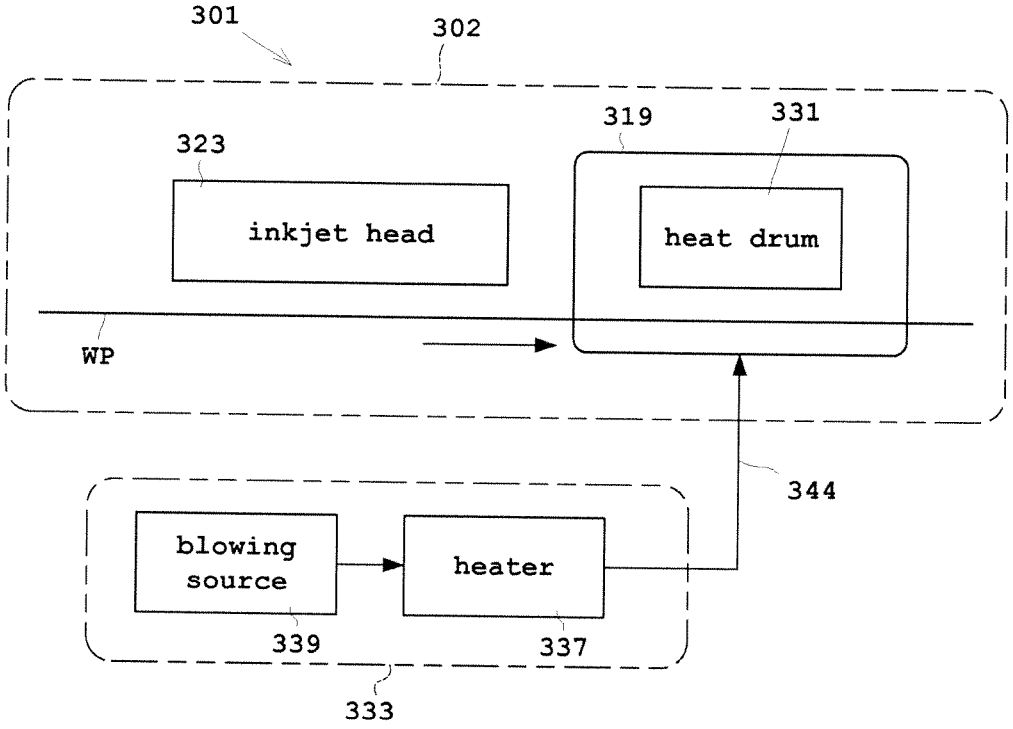
Fig.20 PRIOR ART
FIG. 20 is a schematic view of a conventional inkjet printing apparatus.

(5) In Embodiment 3 mentioned above, the warm-air circulating duct 61 is disposed between the exhaust duct 43 and the suction duct 45, and supplies the warm air collected in the exhaust duct 43 to the suction duct 45, as illustrated in FIG. 8. Alternatively, the warm-air blowing unit 81 may be constructed as illustrated in FIG. 19. That is, the warm-air blowing unit 81 includes the exhaust duct 43, the air-blowing duct 71, and the suction duct 83 configured to supply air to the blowing fan 39. The exhaust duct 43 includes an exhaust fan 85 at the opening 43*a* adjacent to the outside of the inkjet printing unit 2. The exhaust fan 85 exhausts the collected warm air.

The suction duct 83 is enclosed with a partition 83*a*. The suction duct 83 includes a warm-air suction port (also referred to as an exhaust port) 87 configured to suck the warm air blown to the transportation path 35 from the blowing port 41*b*. The warm air collected in the warm-air suction port 87 is supplied through the suction duct 83 to the blowing fan 39. Moreover, the suction duct 83 includes the outside-air suction port 83*b* configured to suck outside air (fresh air) outside the suction duct 83, i.e., outside the inkjet printing unit 2. Furthermore, the suction duct 83 includes the suction fan 89 configured to suck the outside air to a position adjacent not to the warm-air suction port 87 but to the outside air inlet 83*b*. The exhaust fan 85 and the suction fan 89 are each formed by a fan containing a counter-rotating fan or a blower.

The suction fan 89 has a quantity of air smaller than the blowing fan 39. This causes difference in quantity of air between the blowing fan 39 and the suction fan 89. The difference in quantity of air generates a suction force for collecting the warm air from the warm-air suction port 87.

For instance, a ratio is assumed of "2" part of an air quantity r to "1" part of an air quantity s, the air quantity r being from the blowing fan 39 and the air quantity s being from the suction fan 89. This causes difference in air quantity between the blowing fan 39 and the suction fan 89. The difference in air quantity generates a suction force at the warm-air suction port 87. When a quantity of warm air t collected in the warm-air suction port 87 becomes "1" part, a mixing ratio of the outside air to the collected warm air can be of 1:1 (i.e., 50%:50%). Since the air quantity from the blowing fan 39 has the ratio of "2" part, the warm air having a ratio "2" part of an air quantity u is blown from the blowing port 41*b* of the heater casing 41. The exhaust fan 85 collects the remaining warm air (the ratio of an air quantity v of "1" part) in the warm-air suction port 87 through the exhaust duct 43, and exhausts the remaining warm air.

The dry controller 53 controls the blowing fan 39, the exhaust fan 85, and the suction fan 89. The dry controller 53 changes the difference in quantity of air between the blowing fan 39 and the suction fan 89. That is, the dry controller 53 controls the difference in quantity of air from the blowing fan 39 and that from the suction fan 89 by adjusting the number of revolution of the fans. This achieves variation in proportion of the warm air to be circulated.

Here, the warm-air suction port 87 corresponds to the warm-air suction port, the exhaust port, and the warm-air circulator in the present invention. The warm-air suction port 87 may be disposed in the suction duct 83 via the warm-air circulating duct. The exhaust duct 43 is applicable to each modification mentioned above. For instance, in FIG. 17 of the modification (2), the exhaust ducts 43 are disposed on the upstream and downstream sides of the transportation path 35 across the heater casing 41. Either of the two exhaust duct 43 disposed on both sides may be adopted as the warm-air suction port 87. Moreover, in FIG. 19, no air-blowing duct 71 is disposed, but the blowing fan 39 may be disposed at the inflow port 41*b* of the heater casing 41. Furthermore, in FIG. 19, the blowing port 41*b* and the warm-air suction port 87 blow and exhaust air in the vertical direction relative to the sheet of the drawing for convenience of illustration. However, the blowing port 41*b* blows the warm air obliquely to the transportation path 35, and the warm-air suction port 87 opens in a direction where the warm air is readily collected. In addition, there are at least one blowing fan 39, exhaust fan 85, and suction fan 89. In FIG. 19, a rotation direction of the heat drum 31 is denoted by a numeral 91.

(6) In Embodiments 4 and 5 mentioned above, there are two warm-air blowing units 107, i.e., four warm-air blowing units 33 in FIGS. 10 and 11. This is, however, not limitative. The number of warm-air blowing units 107 is set depending on ease in drying the ink droplets of the web paper WP. For instance, three warm-air blowing units 107 may constitute the static pressure generator 103.

(7) In Embodiments 4 and 5 and the modification (6) mentioned above, one warm-air suction port 87 is provided for every suction duct 45 in FIG. 14. On the other hand, in FIG. 12, four (i.e., a plurality of) warm-air suction ports 87 are provided for every suction duct 45. In other words, one or a plurality of warm-air suction ports 87 may be adopted.

(8) In Embodiments 4 and 5 and the modifications (6) and (7) mentioned above, the housing 105 covers the warm-air blowing unit 33, the exhaust duct 43, and the suction duct 45 entirely. Alternatively, the housing 105 may cover at least the nozzle 41*d*, the exhaust duct 43, and the warm-air suction port 87.

(9) In Embodiments 4 and 5 and the modifications (6) to (8) mentioned above, the warm-air blowing unit 107 is formed by two adjacent warm-air blowing units 33 in FIGS. 10 to 14. Alternatively, the warm-air blowing unit 107 may be formed by three adjacent warm-air blowing units 33. In this case, the warm-air blowing unit 107 may be formed by a first warm-air blowing unit 33, a first warm-air suction port 87, a second warm-air suction port 87, a second warm-air blowing unit 33, a third warm-air suction port 87, and a third warm-air blowing unit 33, in this order.

(10) In Embodiments 4 and 5 and the modifications (6) to (9) mentioned above, the suction duct 45 circulates the warm air sucked in the warm-air suction port 87 and then reuses the warm air. Alternatively, the warm-air suction port 87 may be replaced by the exhaust duct, and the exhaust duct may exhaust the warm air blown to the transportation path 35 to the outside of the inkjet printing unit 2.

(11) In Embodiments 4 and 5 and the modifications (6) to (10) mentioned above, the suction duct 45 circulates the warm air sucked in the warm-air suction port 87 and then reuses the warm air. Alternatively, the warm air collected in the exhaust duct 43 may partially be supplied to the suction duct 45.

(12) In Embodiments 4 and 5 and the modifications (6) to (11) mentioned above, the blowing fan 39 may be disposed at the inflow port 41*a* of the heater casing 41 as illustrated in FIG. 4(*a*) of Embodiment 1. Moreover, as illustrated in FIGS. 5 to 7 of Embodiment 2, the temperature sensor 51 may be provided and the temperature controller 53 may perform control such that the quantity of air from the blowing fan 39 decreases as the temperature measured with the temperature sensor 51 decreases.

(13) In each embodiment and modification mentioned above, the inkjet printing apparatus 1 supplies the web paper WP to the inkjet printing unit 2. Alternatively, separated paper may be supplied. Moreover, this is not limited to paper, but a plastic film may be adopted.

(14) In each embodiment and modification mentioned above, the inkjet printing apparatus has been described as one example of the printing apparatus. Alternatively, a printing apparatus such as a rotary press used for offset lithography or gravure printing may be adopted.

REFERENCE SIGN LIST

1 . . . inkjet printing apparatus
17 . . . print unit
19, 101 . . . drying unit
23 . . . inkjet head
31 . . . heat drum
33, 81 . . . warm-air blowing unit
35 . . . transportation path
37 . . . heater
39 . . . fan
41 . . . heater casing
41*a* . . . inflow port
41*b* . . . blowing port
41*c* . . . partition
43 . . . exhaust duct
45, 83 . . . suction duct
51 . . . temperature sensor
53 . . . dry controller
61 . . . warm-air circulating duct
71 . . . air-blowing duct
73 . . . flat plate heater
83*b* . . . suction port
87 . . . exhaust port
89 . . . suction fan
103 . . . static pressure generator
105 . . . housing
107 . . . warm-air blowing unit
115*a*, 115*b* . . . guide plate
201 . . . transportation direction
202 . . . width direction of web paper

What is claimed is:

1. A drying apparatus for drying ink adhering to a print medium, the drying apparatus comprising:

a heater facing a transportation path where the print medium is transported;

a blowing source configured to blow air to the heater; and a casing configured to enclose the heater, the casing comprising:

an inflow port into which the air from the blowing source flows; and a blowing port configured to narrow and blow warm air heated with the heater to the transportation path outside the casing in a direction along the transportation path;

an exhaust unit disposed outside the casing and configured to exhaust the warm air blown through the blowing port to the transportation path;

a suction unit configured to supply air to the blowing source; and a warm-air circulator configured to supply the warm air collected in the exhaust unit to the suction unit, the suction unit comprising:

an outside-air suction port configured to suck outside air;

a warm-air suction port provided as the exhaust unit and the warm-air circulator on a path connecting the blowing source and the outside-air suction port, and configured to suck the warm air blown to the transportation path;

a suction-blowing source provided on the path adjacent to the outside-air suction port rather than the warm-air suction port, and configured to suck the outside air; and a dry controller configured to change difference in quantity of air between the blowing source and the suction-blowing source, wherein the suction-blowing source is set to blow a smaller quantity of air than the blowing source.

2. The drying apparatus according to claim 1, wherein the heater, the blowing source, and the casing constitute a warm-air blowing unit;

a plurality of warm-air blowing units are provided along the transportation path, a plurality of the warm-air suction ports are provided, and each of the warm-air suction ports is respectively disposed between a pair of warm-air blowing units.

3. The drying apparatus according to claim 1, wherein the blowing source is disposed at the inflow port of the casing.

4. The drying apparatus according to claim 1, further comprising:

a temperature sensor disposed at the blowing port; and a dry controller configured to control a quantity of air from the blowing source in accordance with a temperature measured with the temperature sensor, wherein the dry controller controls the quantity of air from the blowing source so as to be lower as the temperature measured with the temperature sensor decreases.

5. The drying apparatus according to claim 1, further comprising:

a drive roller configured to rotate while contacting to a face of the print medium opposite to a face to which the ink adheres; and a static pressure generator disposed opposite to the drive roller across the transportation path where the print medium is transported, the static pressure generator comprising:

a housing configured to partially cover the transportation path on an outer edge of the drive roller, and including a static pressure adjusting device configured to maintain static pressure during passing the print medium through the housing by at least either gradually increasing the static pressure at an inlet of the print medium or gradually decreasing the static pressure at an outlet of the print medium; and a warm-air blowing unit configured to generate warm air and blowing the warm air to the transportation path within the housing, and including the heater, the blowing source, and the casing.

6. The drying apparatus according to claim 5, wherein the drive roller is a heat drum that rotates and performs heating while contacting the face of the print medium opposite to the face to which the ink adheres.

7. The drying apparatus according to claim 5, wherein the print medium is fed from a roll of print medium.

8. The drying apparatus according to claim 5, wherein a plurality of warm-air blowing units each having the heater, the blowing source, and the casing is arranged along the transportation path.

9. The drying apparatus according to claim 5, wherein the blowing source is constituted by a combination of a plurality of fans arranged in series.

10. A printing apparatus for performing printing to a print medium having the drying apparatus according to claim 5.

11. The drying apparatus according to claim 1, further comprising:

a back-face drying unit disposed opposite to the blowing port across the transportation path and configured to dry the ink adhering to the print medium by heating a back face of the print medium, wherein the blowing port blows the warm air to a front face of the print medium.

12. The drying apparatus according to claim 1, wherein a plurality of warm-air blowing units each having the heater, the blowing source, and the casing is arranged along the transportation path.

13. The drying apparatus according to claim 1, wherein the blowing source is constituted by a combination of a plurality of fans arranged in series.

14. A printing apparatus for performing printing to a print medium having the drying apparatus according to claim 1.

* * * * *